US006595705B1

(12) United States Patent
Piccinino, Jr. et al.

(10) Patent No.: US 6,595,705 B1
(45) Date of Patent: Jul. 22, 2003

(54) PHOTOGRAPHIC PROCESSOR HAVING A WASHING ASSEMBLY

(75) Inventors: Ralph L. Piccinino, Jr., Rush, NY (US); Ronald W. Grant, Jr., Caledonia, NY (US); Kevin H. Blakely, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/242,124

(22) Filed: Sep. 12, 2002

(51) Int. Cl.[7] ..... G03D 3/02; G03D 3/08; G03D 3/04

(52) U.S. Cl. ..... 396/619; 396/626; 396/631; 396/635; 396/625

(58) Field of Search ..... 396/619, 625, 396/626, 631, 633–636, 641; 355/27–29, 40, 41; 134/64 P, 64 R, 122 P, 122 R

(56) References Cited

U.S. PATENT DOCUMENTS

| | | | |
|---|---|---|---|
| 3,792,651 | A | 2/1974 | Banks |
| 4,005,463 | A | 1/1977 | Kowalski |
| 4,178,088 | A | 12/1979 | Harding |
| 4,269,501 | A | 5/1981 | Griffith et al. |
| 4,431,294 | A | 2/1984 | Baker |

*Primary Examiner*—Della Rutledge
(74) *Attorney, Agent, or Firm*—David A. Novais

(57) ABSTRACT

A photographic processor and a method of operation is disclosed. The processor is in the form of a circular drum processor into which photographic film is inserted and processed. The processor includes a washing assembly which is adapted to wash the non-emulsion surface of the film and other components of the processor as the processed film is removed from the processor.

11 Claims, 28 Drawing Sheets

PHOTOGRAPHIC PROCESSOR HAVING A WASHING ASSEMBLY

CROSS REFERENCE TO RELATED APPLICATIONS

The present application is related to the following pending patent applications: U.S. Pat. No. 6,485,202 issued Nov. 16, 2002, entitled PHOTOGRAPHIC PROCESSOR AND METHOD OF OPERATION; now U.S. Pat. No. 6,485,202; U.S. patent application Ser. No. 10/027,454 filed Dec. 21, 2001, entitled A PROCESSING SOLUTION DELIVERY SYSTEM HAVING A SUPPLY TUBE AND LEVEL DETECTION SENSOR UNIT FOR USE WITH A PHOTOGRAPHIC PROCESSOR; U.S. Pat. No. 6,485,204 issued Nov. 26, 2002, entitled PHOTOGRAPHIC PROCESSOR HAVING AN ADJUSTABLE DRUM now Pat. No. 6,485,204; U.S. patent application Ser. No. 10/027,432 filed Dec. 21, 2001, entitled CHEMICAL DELIVERY SYSTEM FOR USE WITH A PHOTOGRAPHIC PROCESSOR AND METHOD OF OPERATION; U.S. Pat. No. 6,517,263 issued Feb. 11, 2003, entiled PHOTOGRAPHIC PROCESSOR HAVING SIDE BY SIDE PROCESSING PATHS AND METHOD OF OPERATION; U.S. patent application Ser. No. 10/164,067 filed Jun. 5, 2002 entitled PROCESSING SOLUTION DELIVERY SYSTEM FOR USE WITH A PHOTOGRAPHIC PROCESSOR AND METHOD OF OPERATION; U.S. patent application Ser. No. 10/185,185 filed Jun. 28, 2002 entitled THERMAL MANAGEMENT DRUM FOR A PHOTOGRAPHIC PROCESSOR; U.S. patent application Ser. No. 10/218,807 filed Aug. 14, 2002, entitled ULTRASONIC CLEANING IN BATCH PHOTOPROCESSING EQUIPMENT and U.S. patent application Ser. No. 10/241,359 filed Sept. 11, 2002 entitled PHOTOGRAPHIC PROCESSING DRUM HAVING a METERING BLADE ASEMBLY.

FIELD OF THE INVENTION

The present invention is directed to a photographic processor having a backwashing assembly to wash the non-emulsion side of photographic film.

BACKGROUND OF THE INVENTION

Photographic processors come in a variety of shapes and sizes from large wholesale photographic processors to small micro-labs. As photographic processors become more and more technologically sophisticated, there is a continued need to make the photographic processor as user-friendly and as maintenance-free as possible.

Currently available photographic processors have one or more of the following shortcomings: (1) the film processing time is relatively long; (2) some photographic processors, because of their size, require a large amount of space; (3) some photographic processors may require an unacceptable amount of developing solution due to the design of the processing tank; and (4) some photographic processor generate an unacceptable amount of solution waste due to the design of the processing tank.

Some photographic processors that address the above shortcomings include a single processing chamber. In a processor having a single processing chamber, all the processing steps are set up on the emulsion side of the media. With this type of arrangement, it is difficult to achieve sufficient washing of the non-emulsion side of the media.

SUMMARY OF THE INVENTION

The present invention addresses some of the difficulties and problems discussed above by the discovery of a novel, compact, and portable photographic processor having an internal drum design, which minimizes the chemicals required to process a roll of film and consequently minimizes the amount of waste generated per roll of film processing. The photographic processor is extremely user-friendly and low maintenance.

The processor of the present invention enables the washing of the non-emulsion side of the media by providing for the engagement of a backwashing mechanism or washing assembly. The engagement of the backwashing mechanism or washing assembly can be performed in a manual or automated manner. The washing assembly of the present invention is adapted to wash the non-emulsion side of media or film in the same chamber as other processing chemicals and aids in the cleaning of the processing chamber before the next processing step or stage.

The present invention accordingly relates to a photographic processor which comprises a circular processing drum that defines a processing chamber for processing photographic film therein, with an outer perimeter of the drum comprising a slot through which processed film which is processed in the processing chamber is removed. The slot is in communication with a film path in the drum. The outer perimeter further comprises an aperture located upstream of the slot with respect to a direction of travel of the processed film when the processed film is removed through the slot, and the aperture opens to the film path in the processing chamber. The processor further comprises a washing assembly that includes a nozzle arrangement. The nozzle arrangement is positioned at the aperture to supply washing solution to a surface of the processed film in the film path as the processed film is being removed through the slot.

The present invention further relates to a photographic processor which comprises a processing drum for processing photographic film therein, with an outer perimeter of the drum comprising a slot through which processed film which is processed in the processing drum is removed. The slot is in communication with a film path in the drum. The processor further comprises rollers provided adjacent to the slot for conveying processed film from the film path and through the slot; and washing means for delivering washing solution to a surface of the processed film in the film path at a location upstream of the rollers with respect to a direction of travel of the processed film when the processed film is being removed through the slot, and delivering washing solution to the rollers.

The present invention further relates to a method of processing photographic material, comprising the steps of inserting film to be processed into a circular processing drum, with the film being inserted through a slot in an outer perimeter of the circular processing drum; supplying at least one processing solution onto an emulsion surface of the film in the processing drum to process the film; discharging the at least one processing solution from the processing drum; supplying a first washing solution into the processing drum and onto at least the emulsion surface of the film, discharging the washing solution from the processing drum; removing the processed film from the processing drum through the slot; and supplying a second washing solution to a non-emulsion side of the processed film as the processed film is removed through the slot.

The present invention further relates to a method of washing processed photographic film, comprising the steps of: supplying a first washing solution onto a first surface of photographic film after the photographic film has been processed in a processing drum; removing the processed film from the processing drum; and supplying a second washing solution onto a second surface of the photographic film as the photographic film is removed from the processing drum.

These and other features and advantages of the present invention will become apparent after a review of the following detailed description of the disclosed embodiments and the appended claims.

BRIEF DESCRIPTION OF THE DRAWINGS

The present invention is further described with reference to the appended figures, wherein.

DETAILED DESCRIPTION OF THE INVENTION

Figure 1:
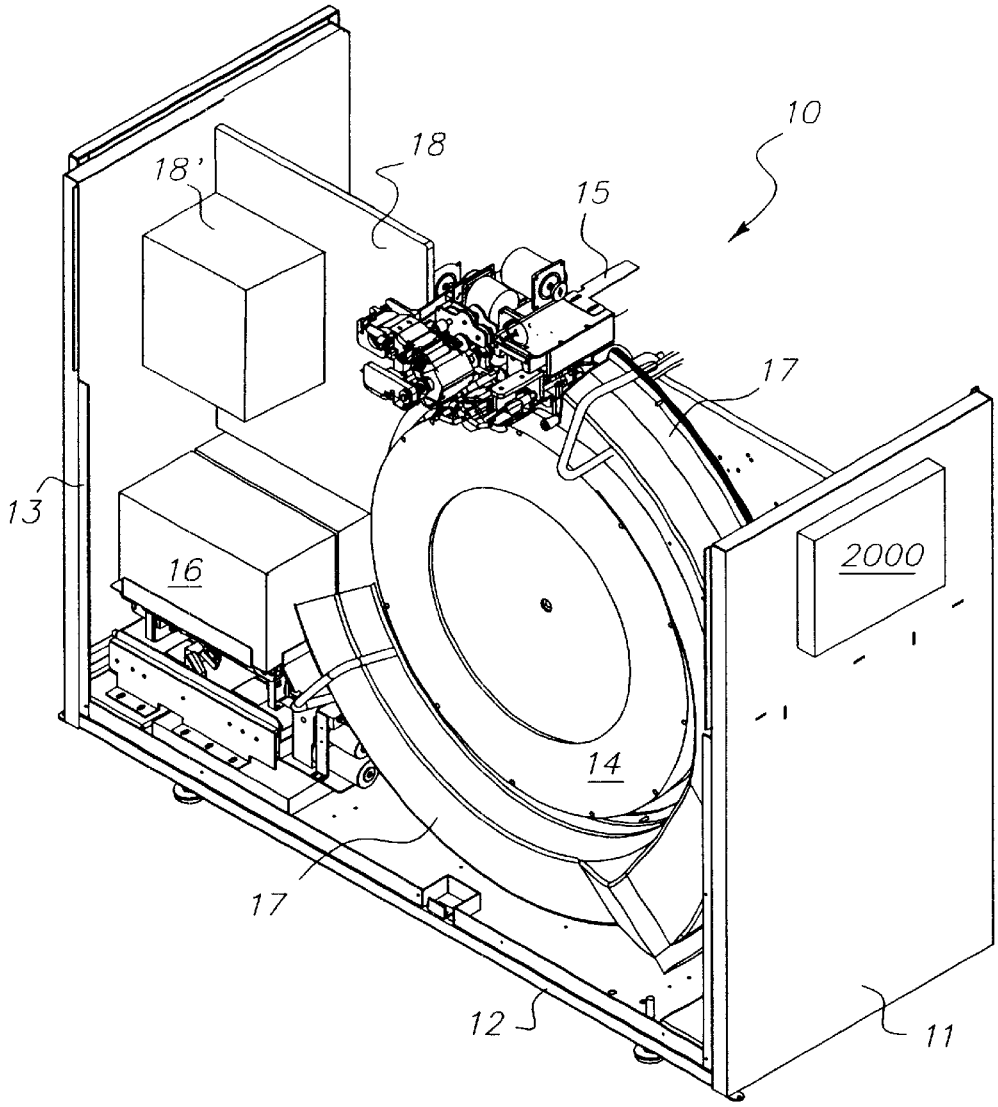
FIG. 1 is a frontal view of an exemplary photographic processor of the present invention.

An exemplary photographic processor is shown in FIG. 1 and described in co-pending application U.S. Ser. No. 10/027,382. As illustrated in FIG. 1, a photographic processor 10 comprises at least an outer housing, which includes a first side wall 11, a base housing member 12, and a second side wall 13. Photographic processor 10 includes a circular processing chamber or drum 14 (also referred to herein as the "circular processing drum 14"), which may be used to expose a given strip or roll of film to one or more photoprocessing chemicals. Photographic processor 10 further includes a film-loading/unloading device 15 positioned above and cooperating with circular processing drum 14. A chemical delivery system 16 is positioned for easy access by a user (i.e., for maintenance or replacement purposes) at a location near side wall 13 and base housing member 12. Photographic processor 10 also includes a circular dryer 17 in the form of, for example, a cylinder, for drying the processed film. Dryer 17 is concentrically and co-axially positioned around processing drum 14. Once a given strip or roll of film is dried in dryer 17, the film proceeds to a scanner 18', which may be positioned above chemical delivery system 16 in a space bordered by side wall 13 and left interior wall 18 or any other convenient location.

Figure 2:
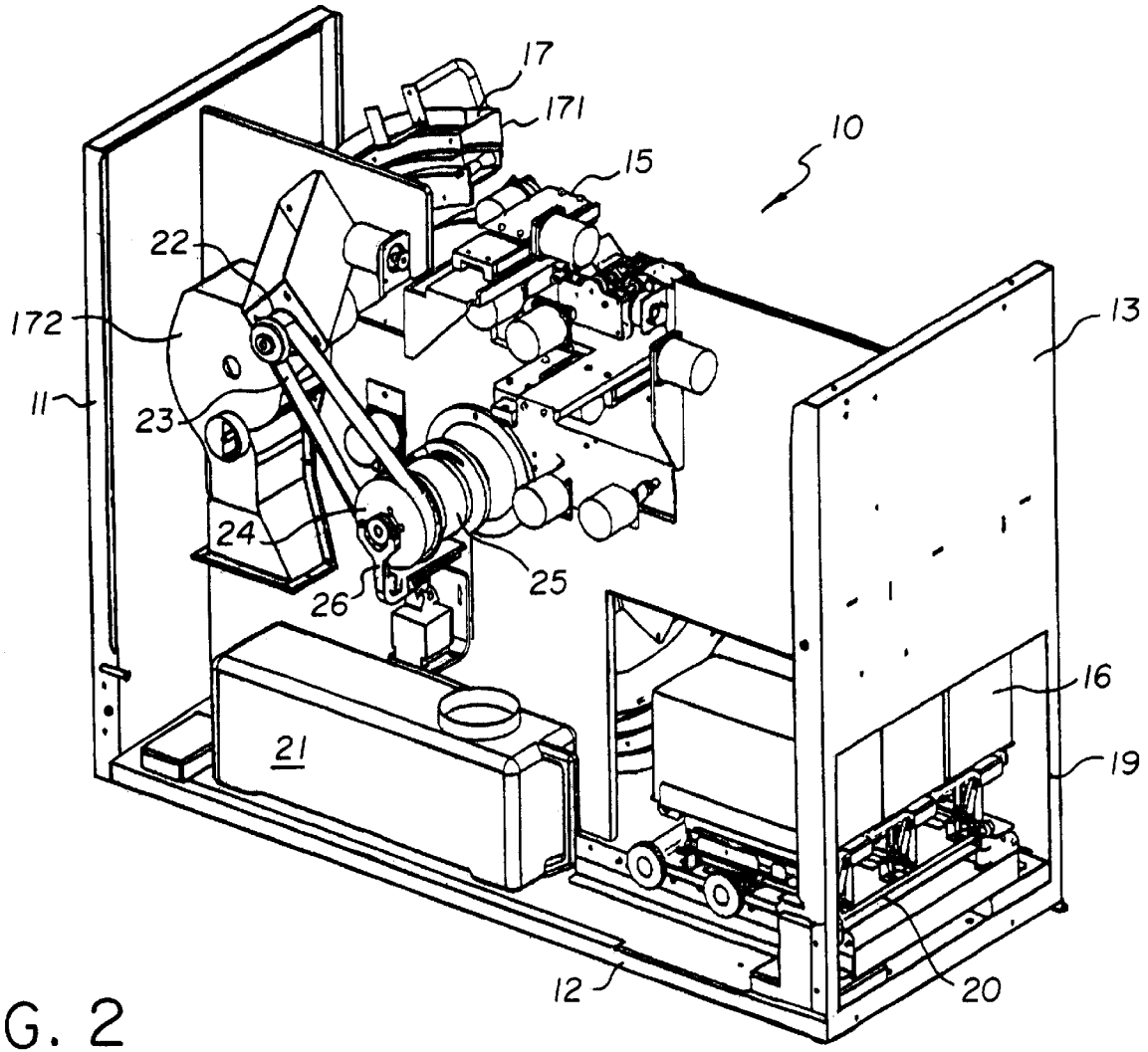
FIG. 2 is a rear view of an exemplary photographic processor of the present invention.

FIG. 2 depicts a rear view of photographic processor 10. As shown in FIG. 2, photographic processor 10 includes opening 19 in side wall 13 for accessing chemical delivery system 16. Sliding track mechanism 20 allows an operator to pull at least a portion of chemical delivery system 16 through opening 19 to an exterior location outside of photographic processor 10. Such an assembly allows for quick and easy maintenance and replacement of chemical delivery system 16. Photographic processor 10 can include a waste collection reservoir 21, which collects and stores used processing chemicals removed from circular processing drum 14 following development of a given strip or roll of film. As shown in FIG. 2, dryer 17 includes dryer entrance 171 and dryer blower 172. The various components of photographic processor 10 will be described in more detail below with reference to FIGS. 3–21.

Figure 3:
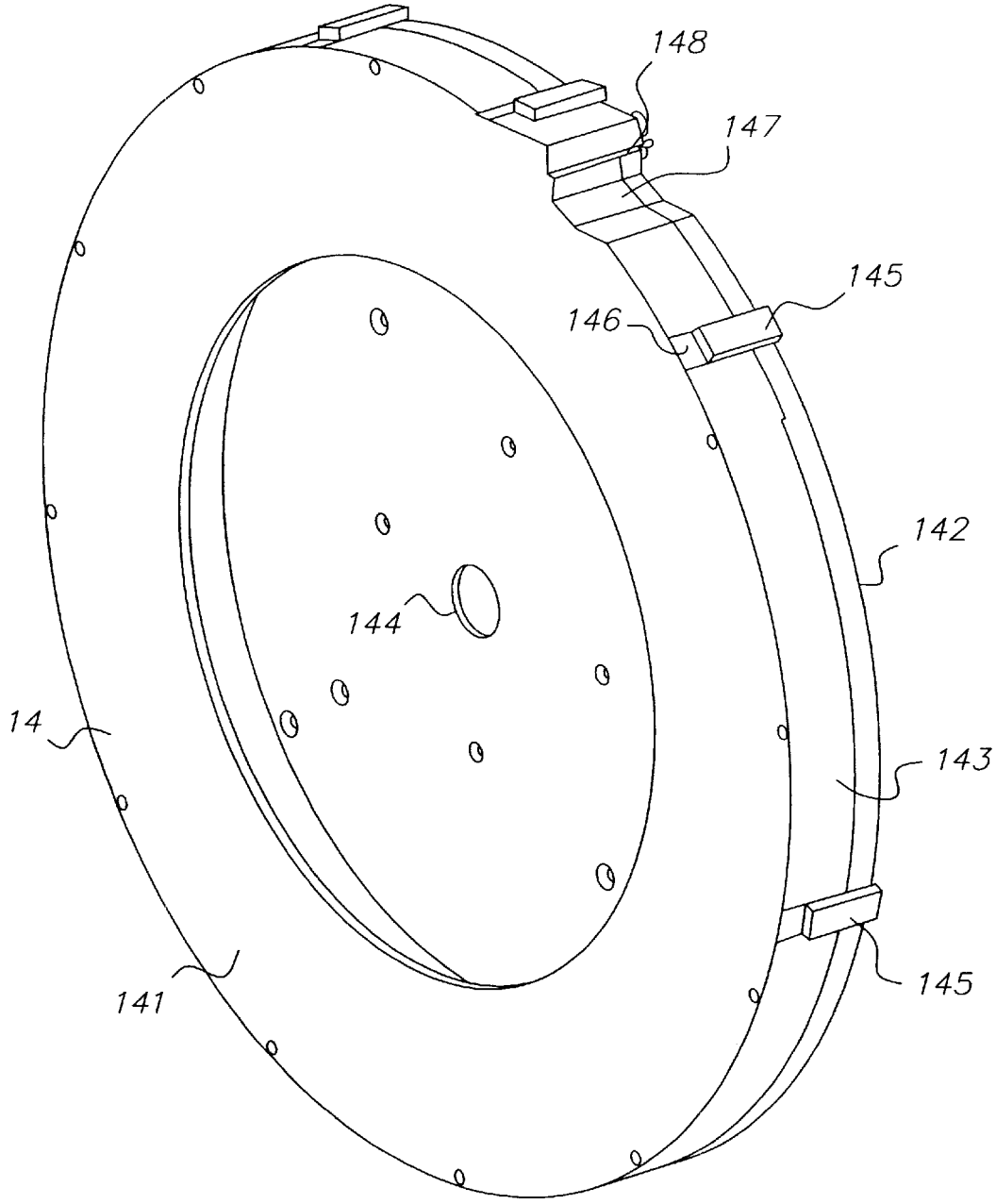
FIG. 3 depicts an exemplary circular processing drum used in the photographic processor of the present invention.

Circular processing drum 14 is further described in FIG. 3. As shown in FIG. 3, circular processing drum 14 includes a first or front wall 141, a second or back wall 142, a side wall 143, and a central axis opening 144. A portion of a drum and disk drive mechanism 25 (shown in FIGS. 2, 8 and 9) passes through central access opening 144. Circular processing drum 14 comprises two circular sections joined together at multiple locations around the perimeter of circular processing drum 14 via male clasping members 145 and female clasping members 146. It should be noted that any means for attaching the two circular components of circular processing drum 14 may be used in place of male clasping members 145 and female clasping members 146. Further, it should be noted that circular processing drum 14 may also be in the form of a single component as oppose to two circular components as shown in FIG. 3, although such a design may add manufacturing cost to circular processing drum 14.

Circular processing drum 14 further comprises a film cartridge loading area 147 on an outer surface of side wall 143 for loading film directly from a film cartridge into circular processing drum 14, such as with APS film. Circular processing drum 14 also comprises a film input slot 148, which enables the entry and exit of film into circular processing drum 14.

Figure 4:
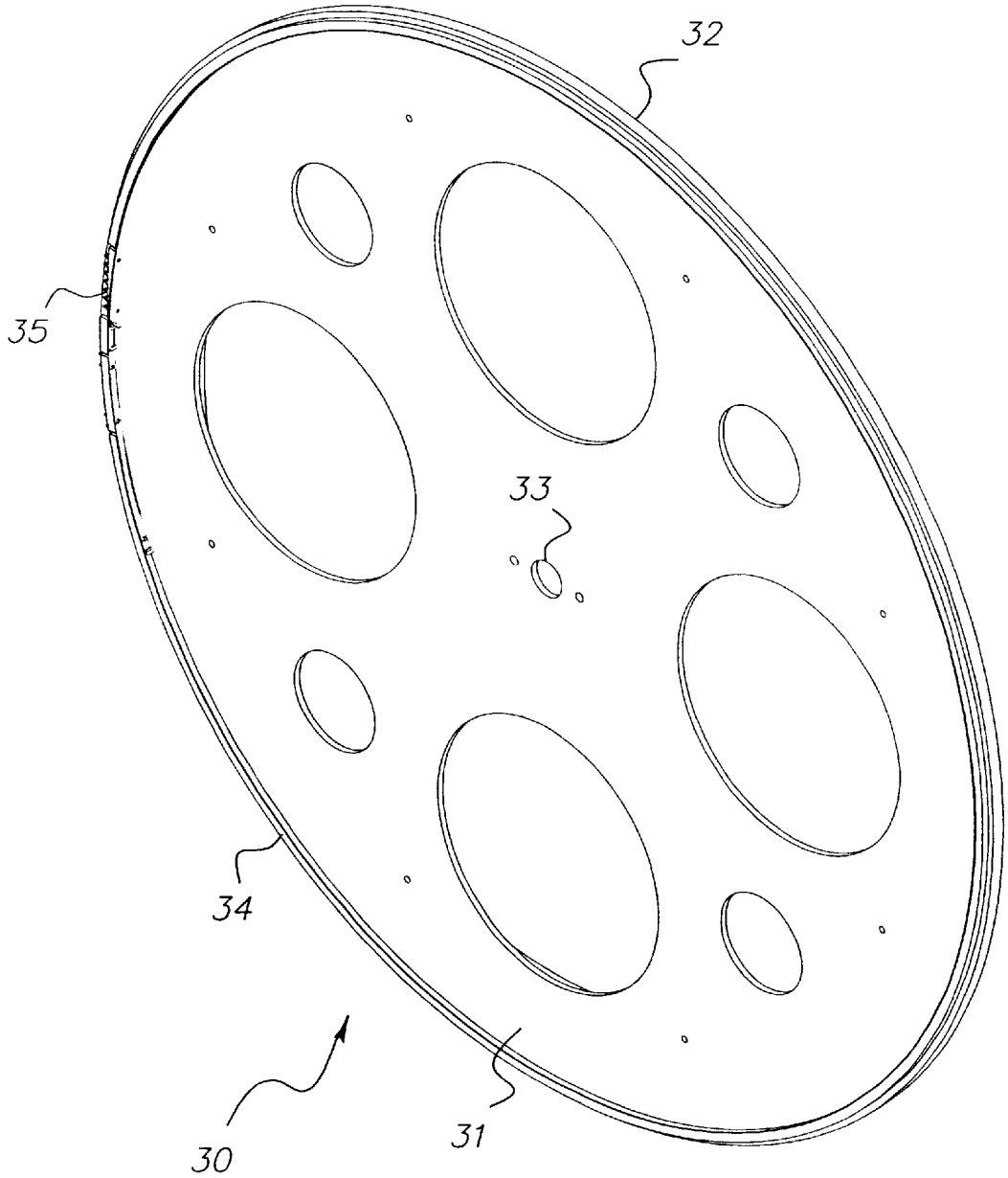
FIG. 4 depicts an exemplary disk located within the circular processing drum of the present invention.
Figure 5:
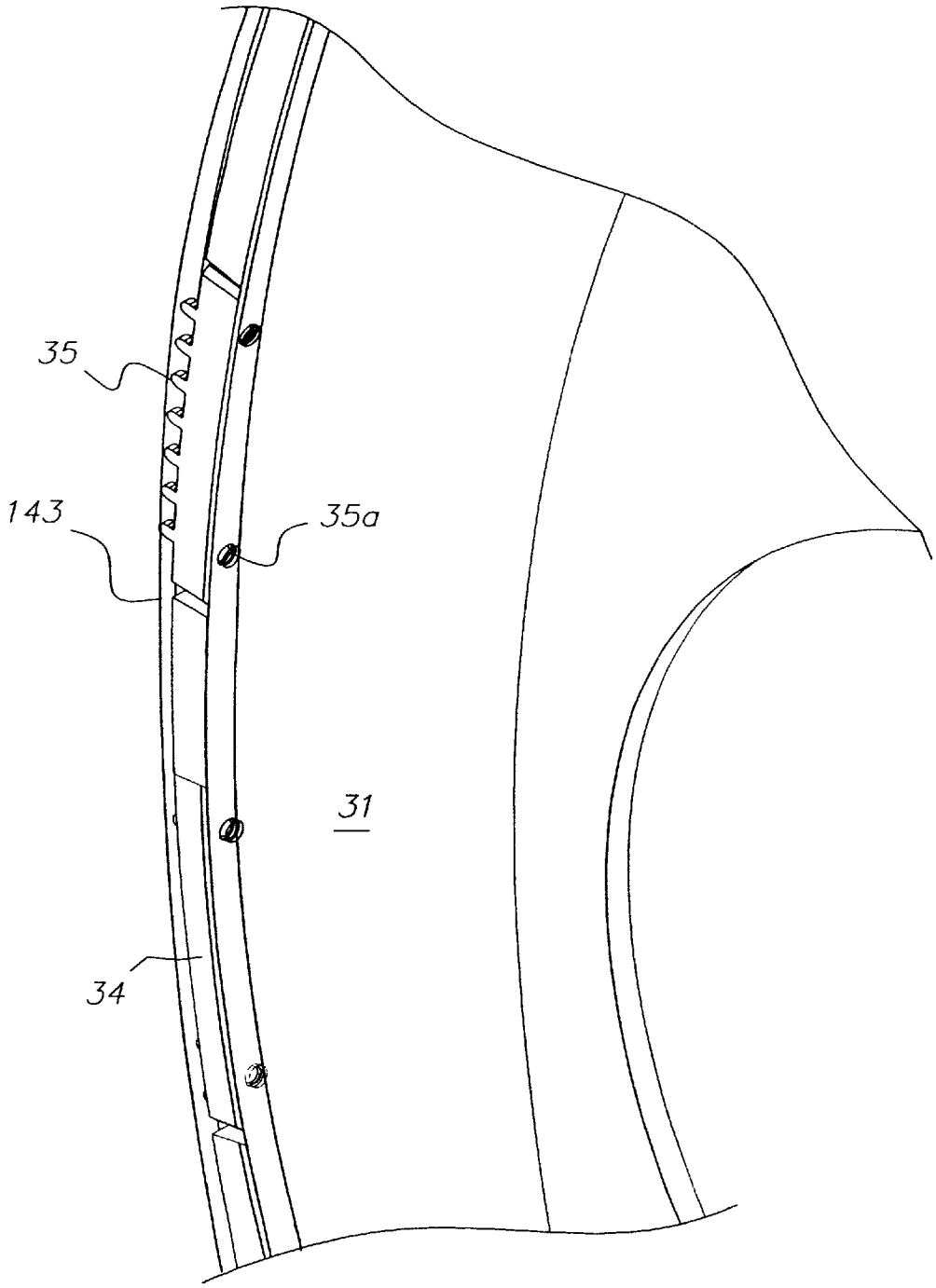
FIG. 5 displays a close-up view of an exemplary disk having an outer perimeter and one or more sets of disk teeth.
Figure 6:
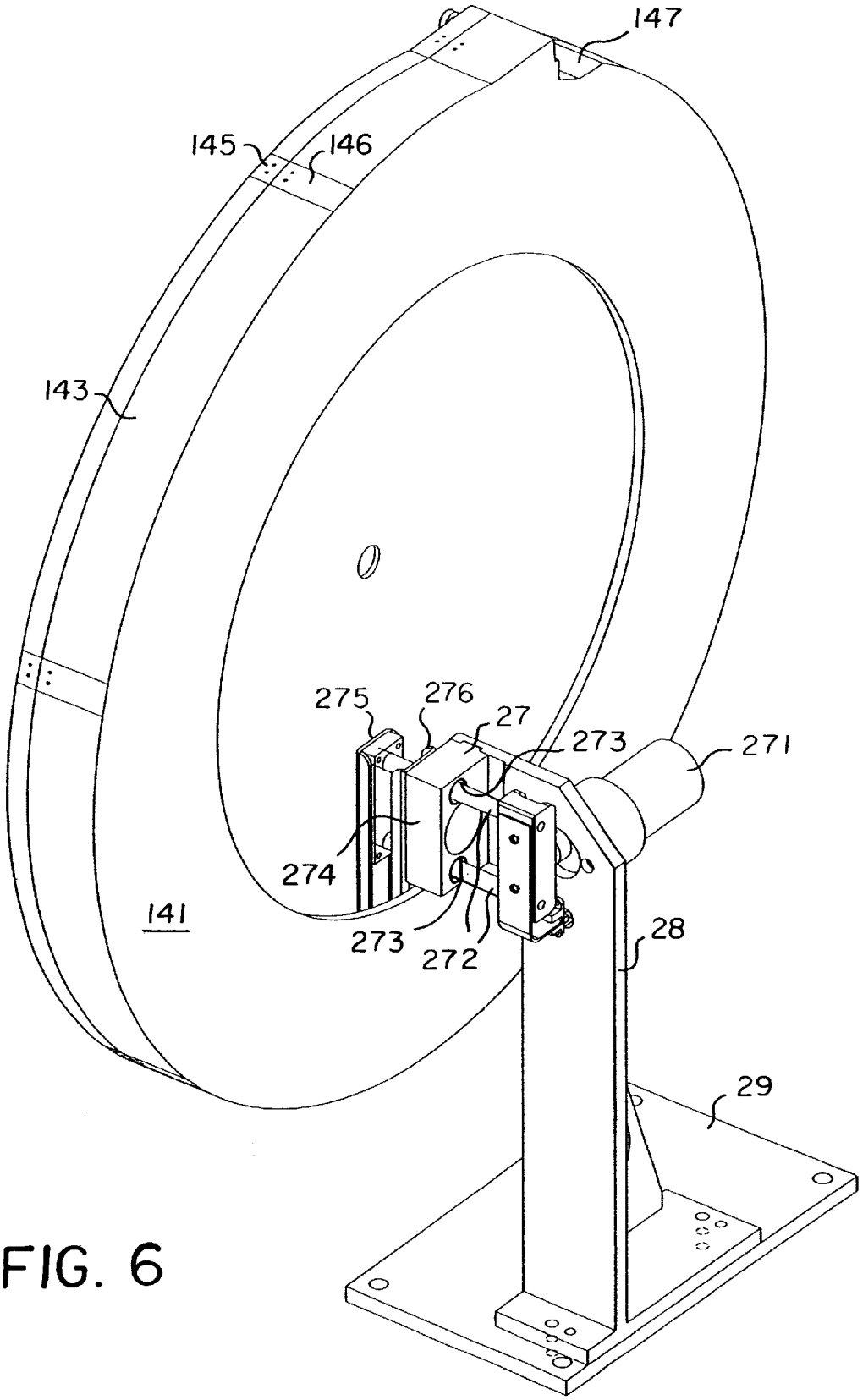
FIG. 6 depicts an exemplary roller mechanism positioned within the circular processing drum.

FIG. 4 depicts an exemplary disk 30, which is positioned within circular processing drum 14, and functions to convey film within circular processing drum 14 once the film enters through film input slot 148. Disk 30 includes a first face 31, a second face 32, a central access opening 33, an outer perimeter 34, and one or more sets of disk teeth 35 located along outer perimeter 34 of disk 30. As with circular processing drum 14, a portion of drum and disk drive mechanism 25 may extend into central access opening 33 to engage with and cause rotation of disk 30. FIG. 5 provides a close-up view of a portion of disk 30, and in particular, outer perimeter 34 and a set of disk teeth 35 on the outer perimeter 34 of disk 30. The outermost points of disk teeth 35 are in close proximity to an inner surface of side wall 143 of circular processing drum 14. In a feature of the invention, disk teeth 35 could be spring loaded through the use of spring arrangement 35*a*.

Figure 7:
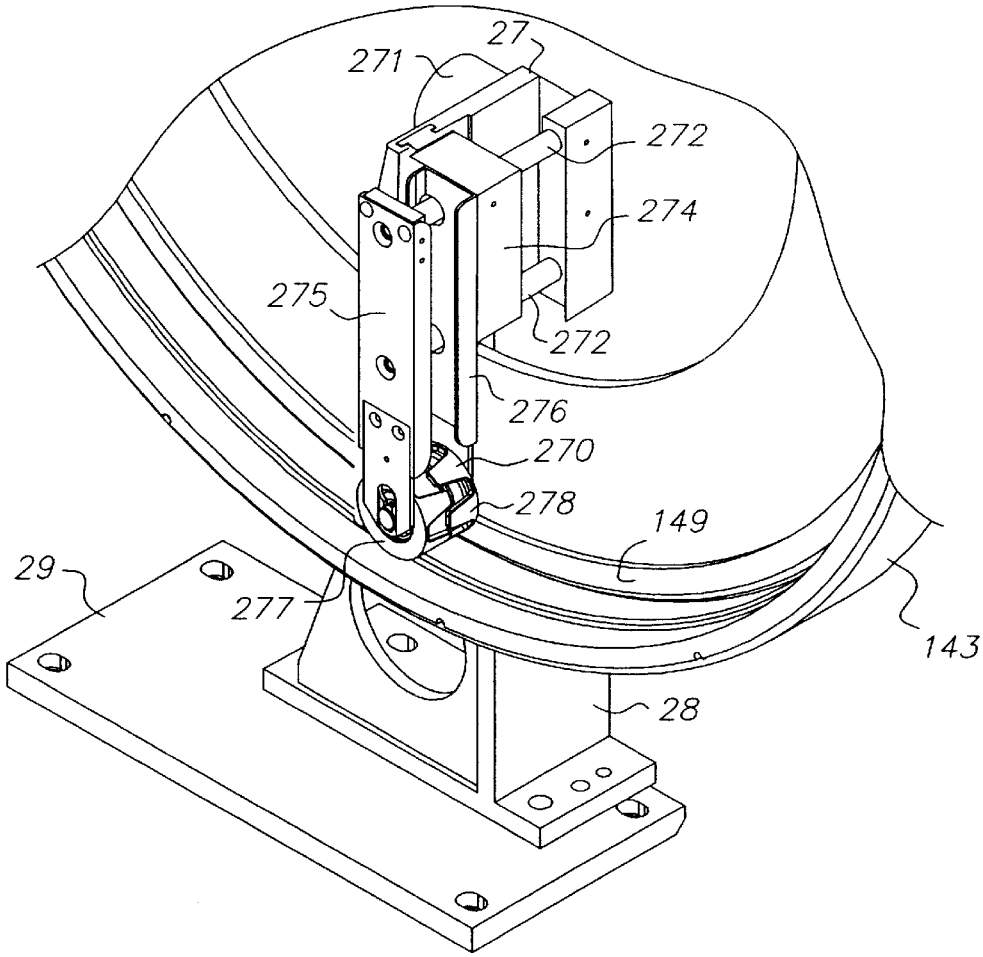
FIG. 7 depicts a rear view of the exemplary roller mechanism of FIG. 6.

A roller arrangement 27 (FIGS. 6 and 7) is positioned within circular processing drum 14. Roller arrangement 27 includes a roller 270 having interengaging members 277 and 278 (FIG. 7). Roller arrangement 27 may be supported by a support member 28, which is attached to a support member base 29. Support member base 29 may be permanently or temporarily attached to base housing member 12 (shown in FIGS. 1 and 2). Roller arrangement 27 includes a motor 271, which provides motion to pistons 272 through openings 273 in a fixed positioning member 274. Pistons 272 proceed through stationary positioning support member 276 and are attached to movable positioning support member 275. As pistons 272 move, movable positioning support member 275 which is coupled to member 277 separates from stationary positioning support member 276 which is coupled to member 278. This permits roller 270 to be expandable between a first width when the members 277 and 278 overlap each other and a second width larger than the first width (FIG. 7) when the members 277 and 278 move away from each other.

FIG. 7 provides a detailed view of roller arrangement 27 and its various components. As shown in FIG. 7, movable positioning support member 275 and stationary positioning support member 276 connect to interengaging members 277 and 278 respectively as described above. During use, the film passes between roller 270 and an interior surface of drum 14. Roller 270 is freely rotatable and maintains the film flat along the lower portion of drum 14. As will be described later, roller 270 further provides an agitating feature within processing drum 14 during processing. Additionally, the width of roller 270 is adjustable as described above to accommodate a shorter width film (i.e. APS film) and a larger width film (i.e. 35 mm film). Further, roller arrangement 27 including roller 270 can be vertically adjustable to accommodate for film curl as the film passes between roller 270 and the interior surface of drum 14. As a still further option, roller 270 can be spring loaded so as to accommodate any variation in the interior surface of drum 14.

Figure 8:
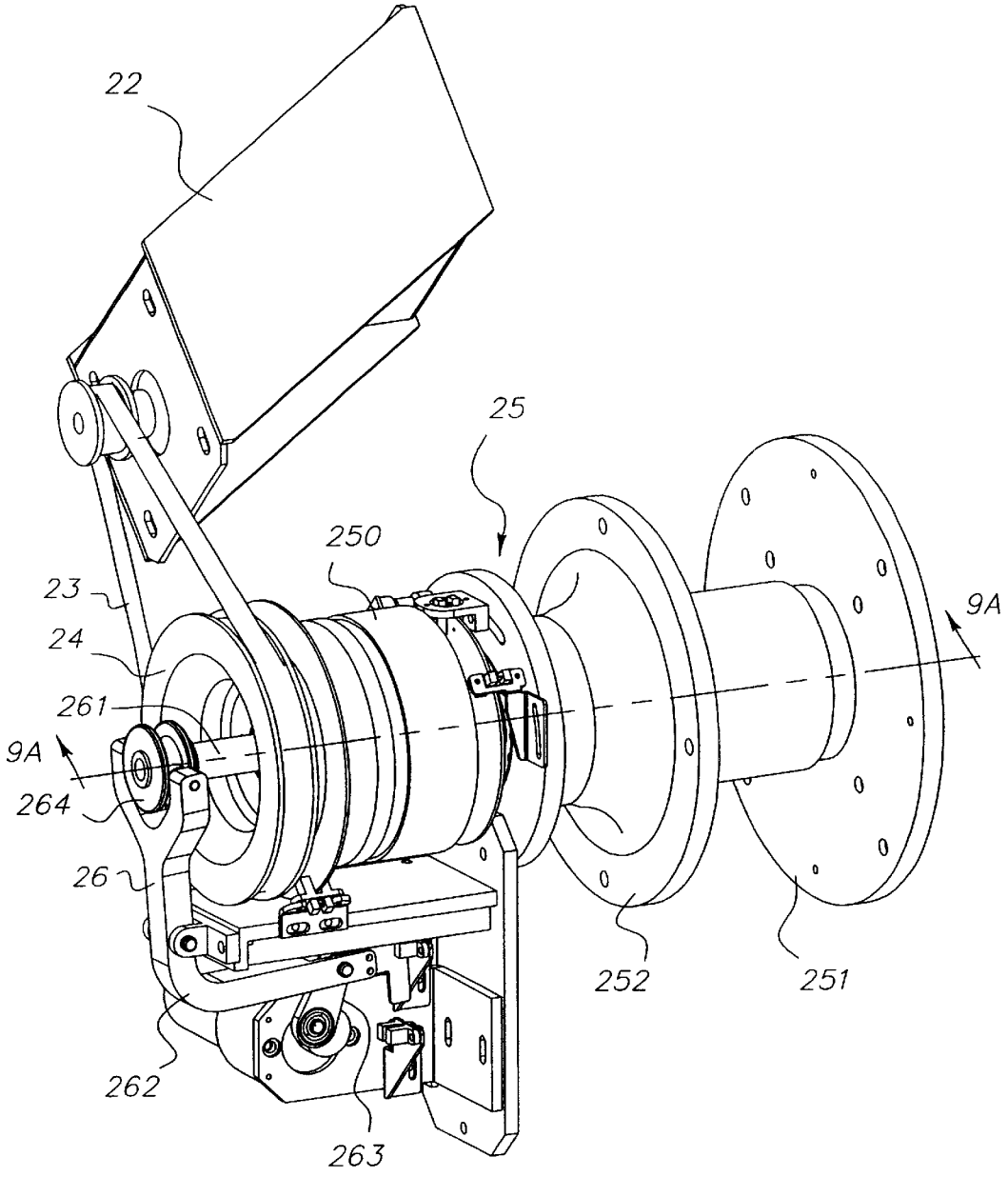
FIG. 8 depicts an exemplary drum and disk drive mechanism for rotating a circular processing drum, and a clutch mechanism for selectively engaging the drum and disk.
Figure 9A:
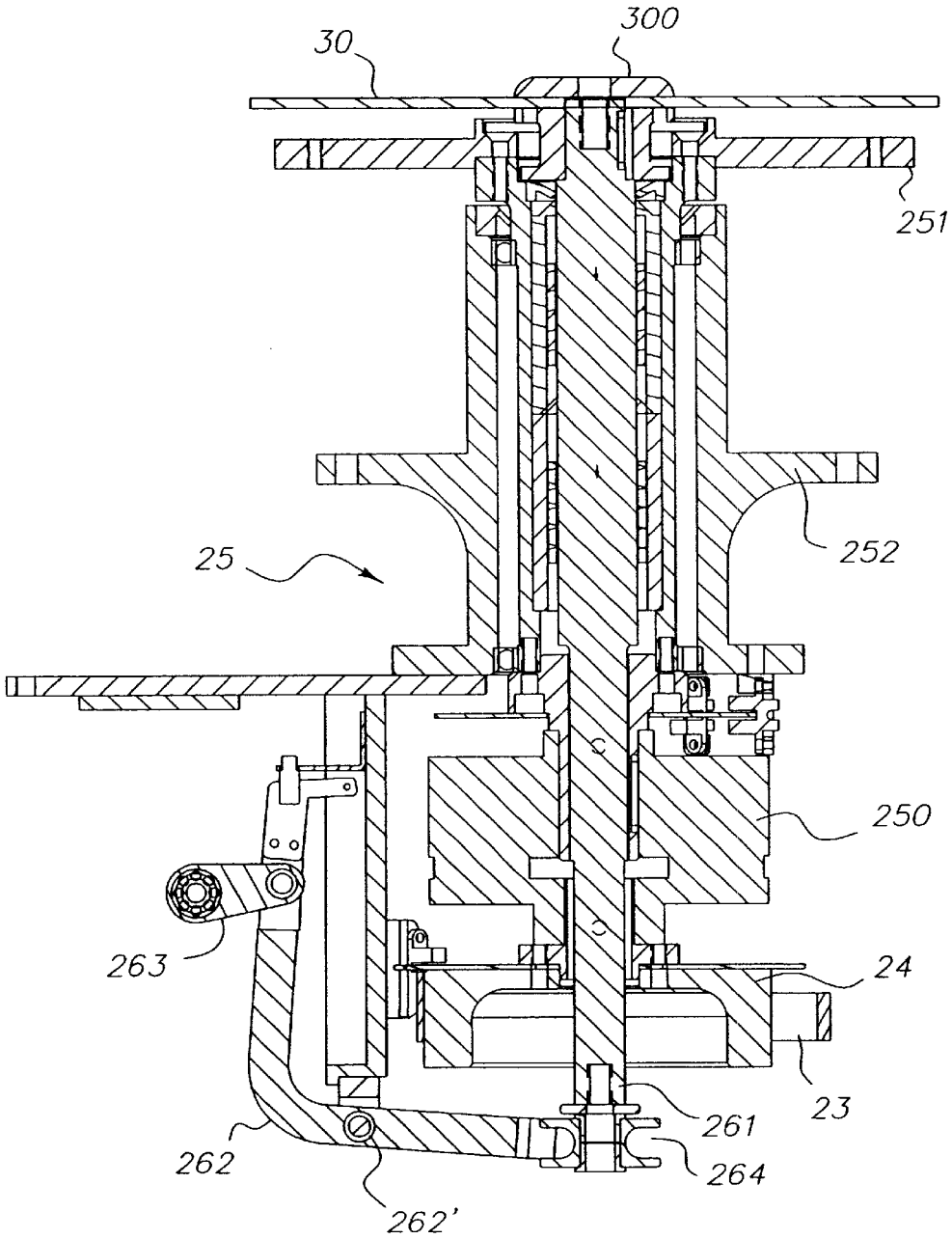
FIG. 9A displays a cross-sectional view of the drum and disk drive mechanism along line A—A in FIG. 8.

Circular processing drum 14 is connected to a drum and disk drive mechanism 25, which selectively rotates disk 30 relative to drum 14 to position and convey the film along and within processing drum 14, and rotates both disk 30 and drum 14 together during a processing and/or cleaning cycle. Circular processing drum 14 rotates about an axis of symmetry. An exemplary drum and disk drive mechanism 25 is shown in FIG. 8. Drum and disk drive mechanism 25 cooperates with a motor 22, a belt 23, and a pulley 24 as shown in FIGS. 8 and 9A. Drum and disk drive mechanism 25 includes a drive shaft 261 which is operationally connected to pulley 24. Also shown in FIGS. 8 and 9A are flanges 251 and 252. Flange 251 is connected to drum 14 while an end cap 300 holds disk 30 for rotation about drive shaft 261 (FIG. 9A). Actuation of motor 22 drives belt 23 which in turn drives pulley 24. This in turn causes a rotation of drive shaft 261 which rotates disk 30. Clutch mechanism 250 enables the engagement and disengagement of flange 251 to provide selective rotation to circular processing drum 14.

Figure 9B:
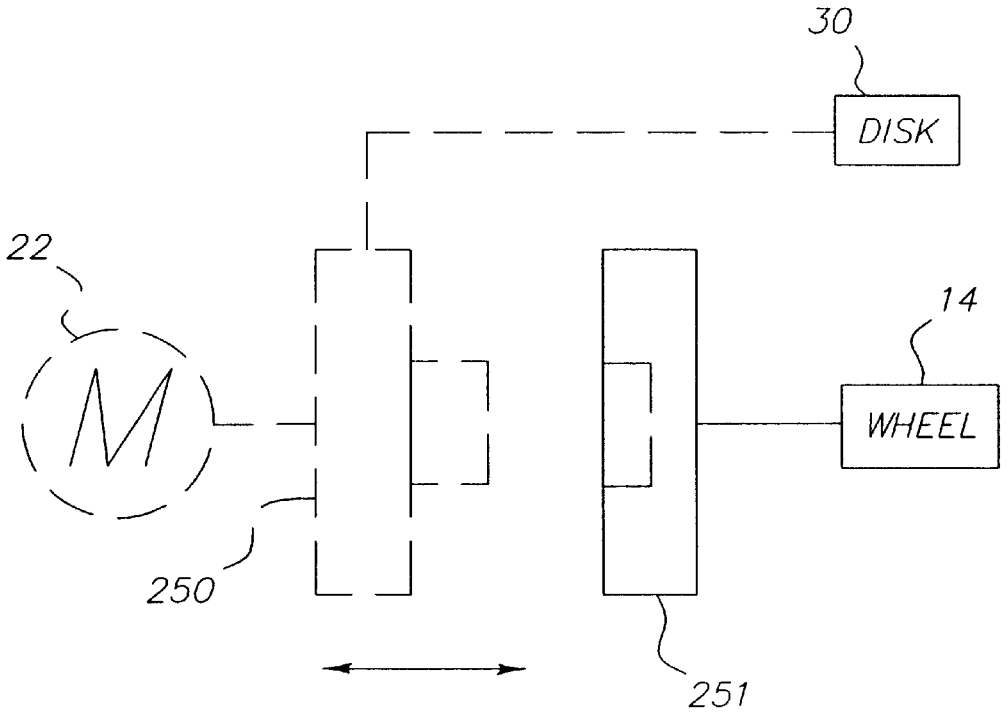
FIG. 9B schematically illustrates a driving and clutching arrangement of the invention.

FIG. 9A displays a cross-sectional view of drum and disk drive mechanism 25 and clutch mechanism 250 along line 9A—9A in FIG. 8. With reference to FIG. 9A and FIG. 9B which is a schematic representation of the driving and clutching feature of the present invention, an operation will now be described. When loading film which will be described with reference to FIGS. 10 and 11, clutch 250 is deactivated as shown in FIG. 9B. In this state, rotation of motor 22 will cause a rotation of drive shaft 261 and accordingly, a rotation of disk 30 relative to drum 14. This is due to the fact that clutch 250 is deactivated and therefore, drum 14 is not rotated. This permits the conveyance of the film by rotation of disk 30 to a desired location within drum 14. After the film reaches the desired location within drum 14, clutch 250 is activated, (for example, clutch 250 is moved to the right in FIG. 9B) by actuating clutch 250 with flange 251 which is attached to drum 14. Therefore, a rotation of motor 22 will cause a rotation of both disk 30 and drum 14. This occurs during the processing stages to process the film in a manner which will be described later, and also during a cleaning stage.

Drive shaft 261 can be moved perpendicularly and through flange 251 and flange 252 to move disk 30 attached thereto. As shown in FIG. 9A, drive shaft 261 is attached to a fitting 264 in a manner which permits drive shaft 261 to rotate relative to fitting 264. Fitting 264 is in turn rotatably attached to a pivotable arm 262 and a movable member 263. Movable member 263 can be operationally connected to a motor for rotation of member 263. This causes arm 262 to pivot about point 262' to move drive shaft 261 to the left or right when viewing FIG. 9A from above the page. Movement of drive shaft 261 as noted above, moves disk 30 in a direction parallel to an axis of disk 30. This facilitates the accommodation of, for example, 35 mm and APS film on disk 30, since the disk 30 can be moved based on the type of film being processed.

Figure 10:
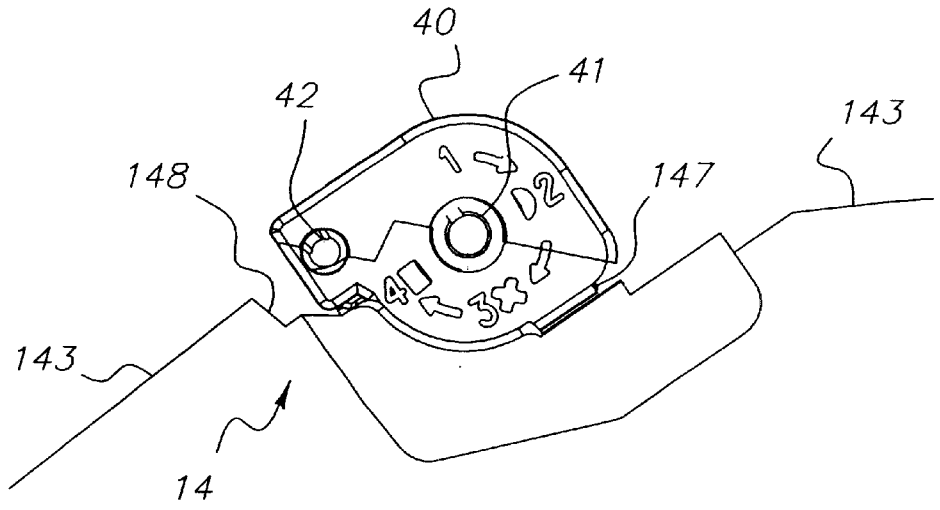
FIG. 10 depicts a film cartridge in a film-loading position using one film-loading method of the present invention.

Within the context of the present invention, a film may be loaded into circular processing drum 14 by a number of methods. One method of loading film, such as APS film, into circular processing drum 14 is shown in FIGS. 10–13. As shown in FIG. 10, film cartridge 40 comprising a film cartridge spool 41 and film cartridge door opening mechanism 52 is positioned in a film cartridge loading area 147 located on side wall 143 of circular processing drum 14.

Film (not shown) exiting film cartridge 40 enters circular processing drum 14 at light tight film input slot 148 (FIG. 3) in side wall 143 of circular processing drum 14.

Figure 11:
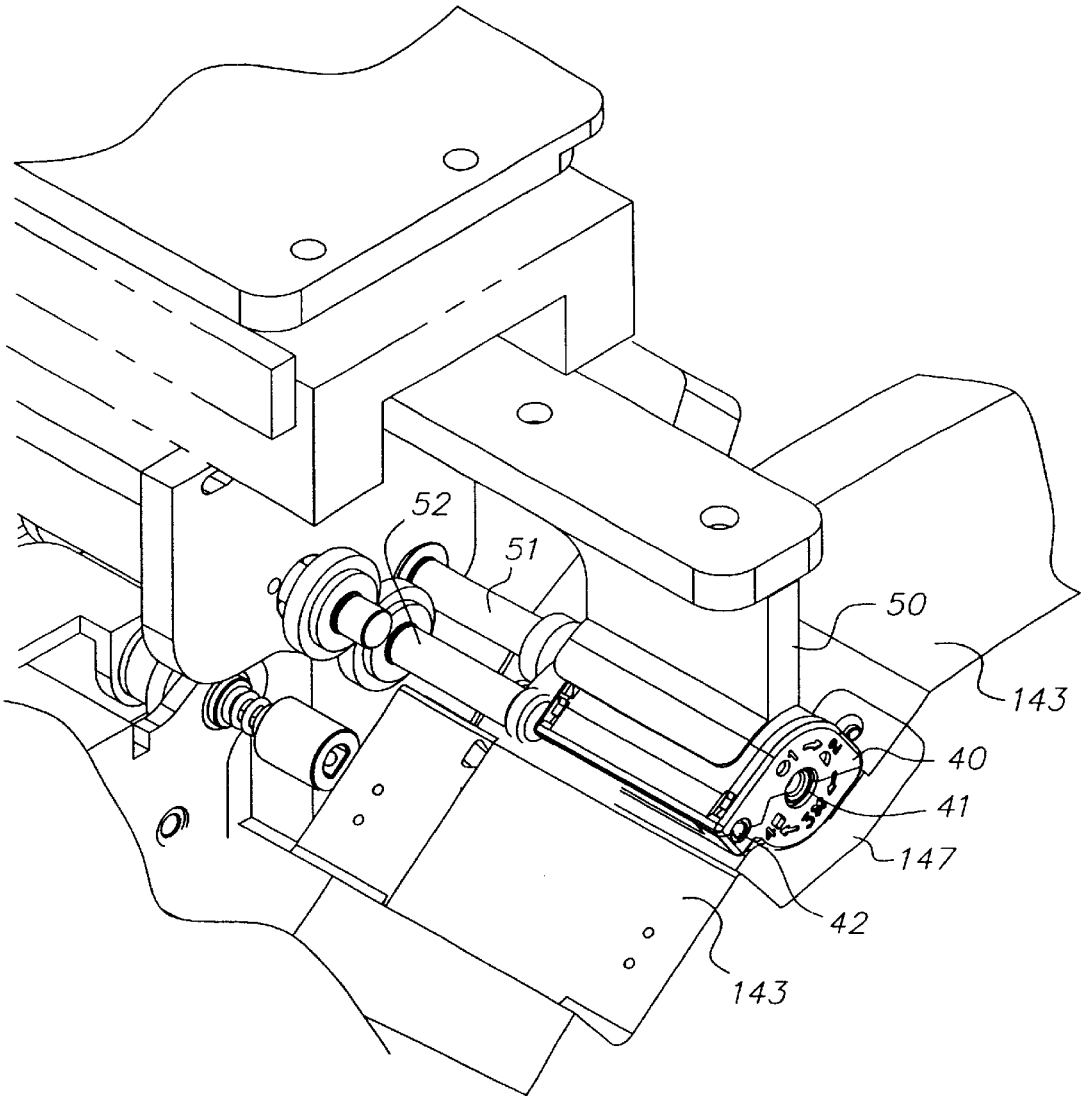
FIG. 11 depicts a film cartridge stabilizing step in one film-loading method of the present invention.

Once film cartridge 40 is positioned in film cartridge loading area 147, photographic processor 10 can initiate a number of film-loading and conveying steps, the results of which are shown in FIG. 11. It is noted that the film loading and conveying steps as well as other processing steps can be controlled by a computer or central processing unit (CPU) 2000 (FIG. 1) operationally associated with processor 10. In a first step, a film cartridge stabilizing member 50 applies an amount of pressure onto an upper surface of film cartridge 40 to prevent film cartridge 40 from moving while positioned in film cartridge loading area 147. Spool engaging member 51 and cartridge door opening mechanism engaging member 52 move toward film cartridge 40 and engage with film cartridge spool 41 and film cartridge door 42, respectively. Door opening mechanism engaging member 52 opens film cartridge mechanism 42 and spool engaging member 51 begins to rotate film cartridge spool 41, forcing film (not shown) out of film cartridge 40.

Figure 12:
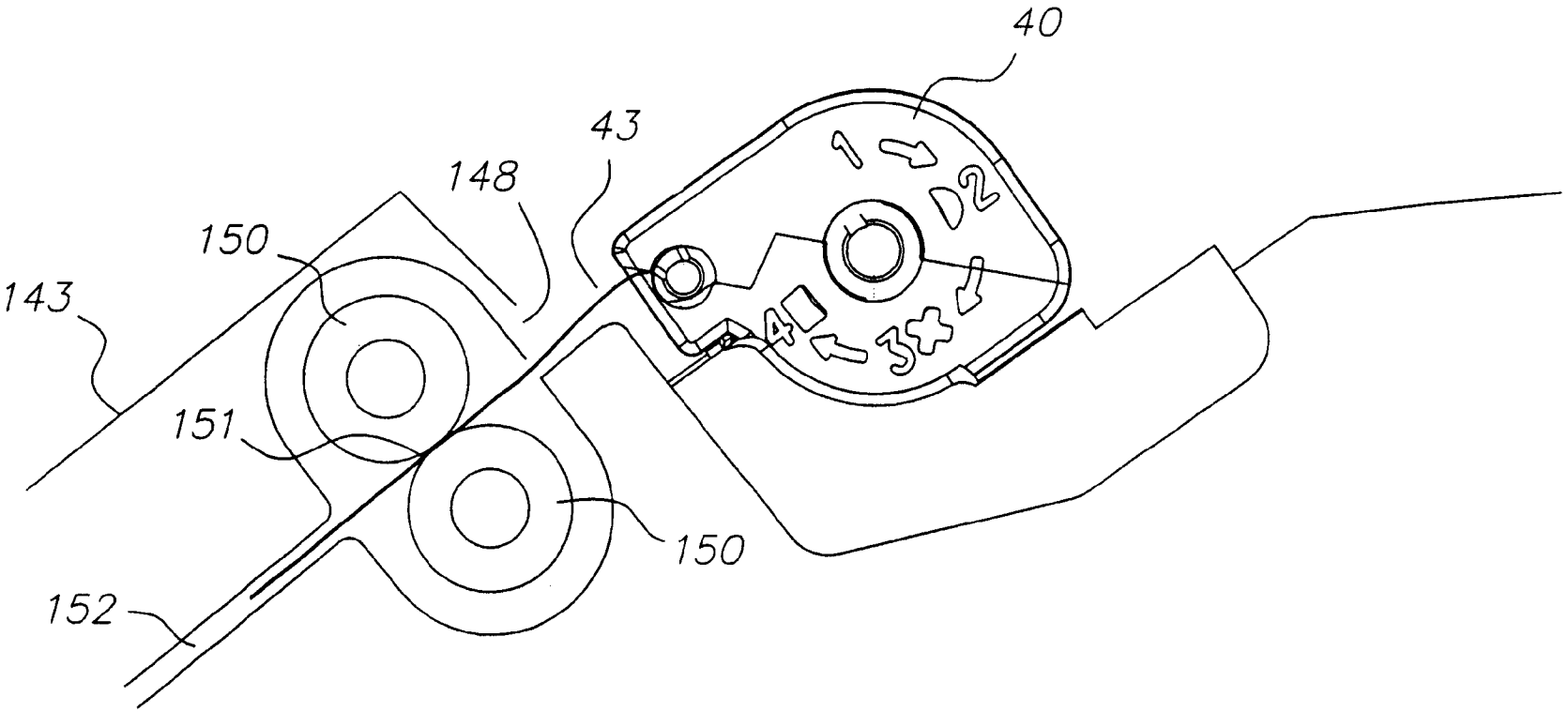
FIG. 12 depicts a film nipping step during a film-loading method of the present invention.
Figure 13:
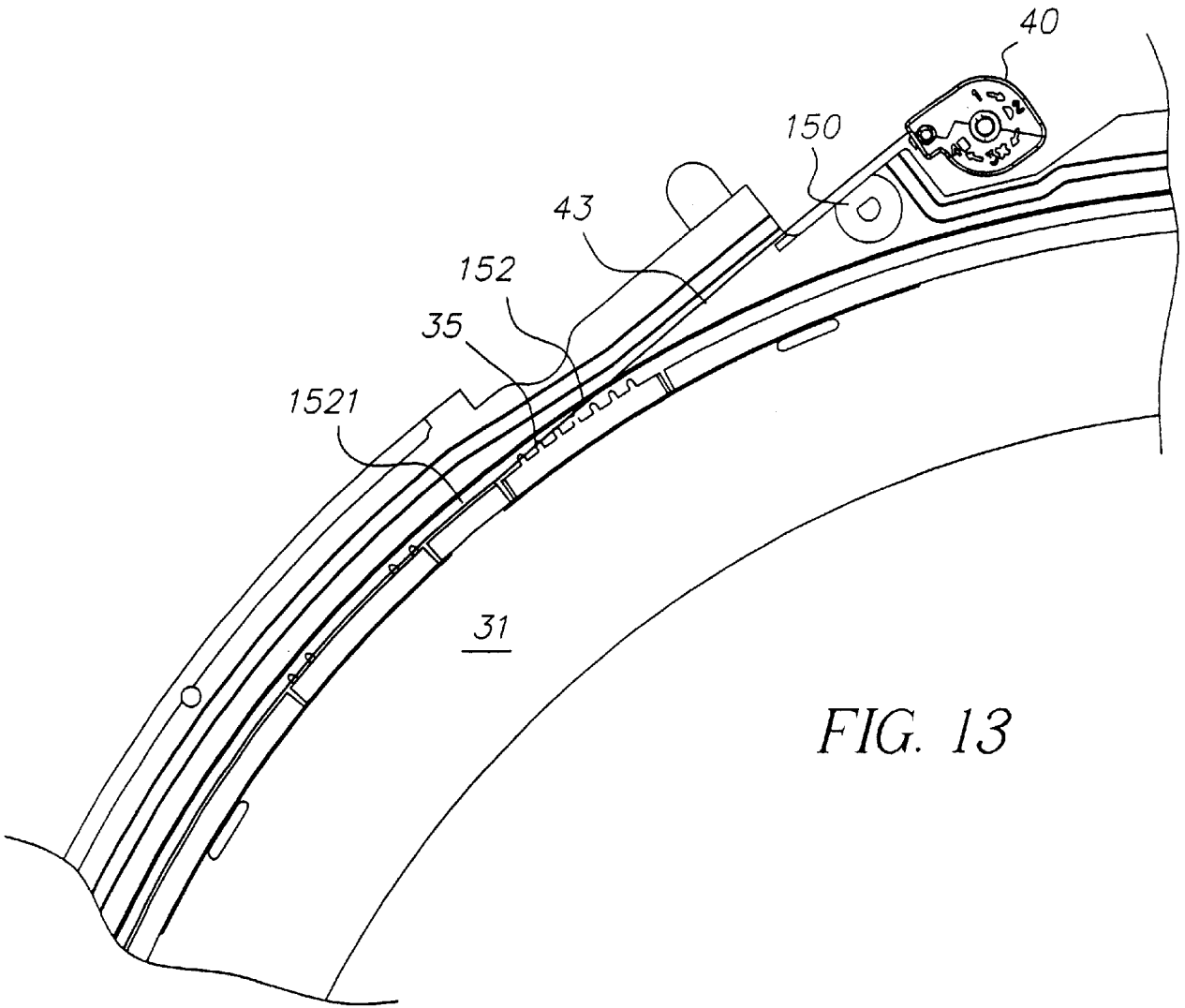
FIG. 13 depicts a cross-sectional view of film entering into a circular processing drum in one film-loading method of the present invention.

FIG. 12 shows a strip of film 43 exiting film cartridge 40 and entering film input slot 148 of circular processing drum 14. Driven nip rollers 150 grasp a leading edge of the strip of film 43 at drum roller nip point 151 and advance film 43 further into circular processing drum 14. As shown in FIG. 13, the strip of film 43 exits drum cavity slot 152 and enters into the drum processing cavity 1521 of circular processing drum 14, wherein one or more sets of disk teeth 35 on disk 30 interengage with holes or perforations along an edge of the strip of film 43. As previously described, disk teeth 35 could be spring loaded so as to spring up at the appropriate time and interengage with the holes or perforations along film 43. With clutch 250 disengaged, disk 30 and rollers 150 are rotated while circular processing drum 14 remains stationary. This causes film 43 to advance into the processing cavity 1521 of circular processing drum 14 a desired distance equal to the length of the strip or roll of film 43. As shown in FIGS. 10–13, in this film-loading method the film 43 remains intact with film cartridge 40.

A number of commercially available films may be loaded according to the film-loading method described above, namely, wherein the film remains intact with its corresponding film cartridge during processing. A suitable film, which may be used in this particular film-loading method, includes, but is not limited to, APS film. Desirably, APS film is loaded into the photographic processor of the present invention according to this method.

Figure 14:
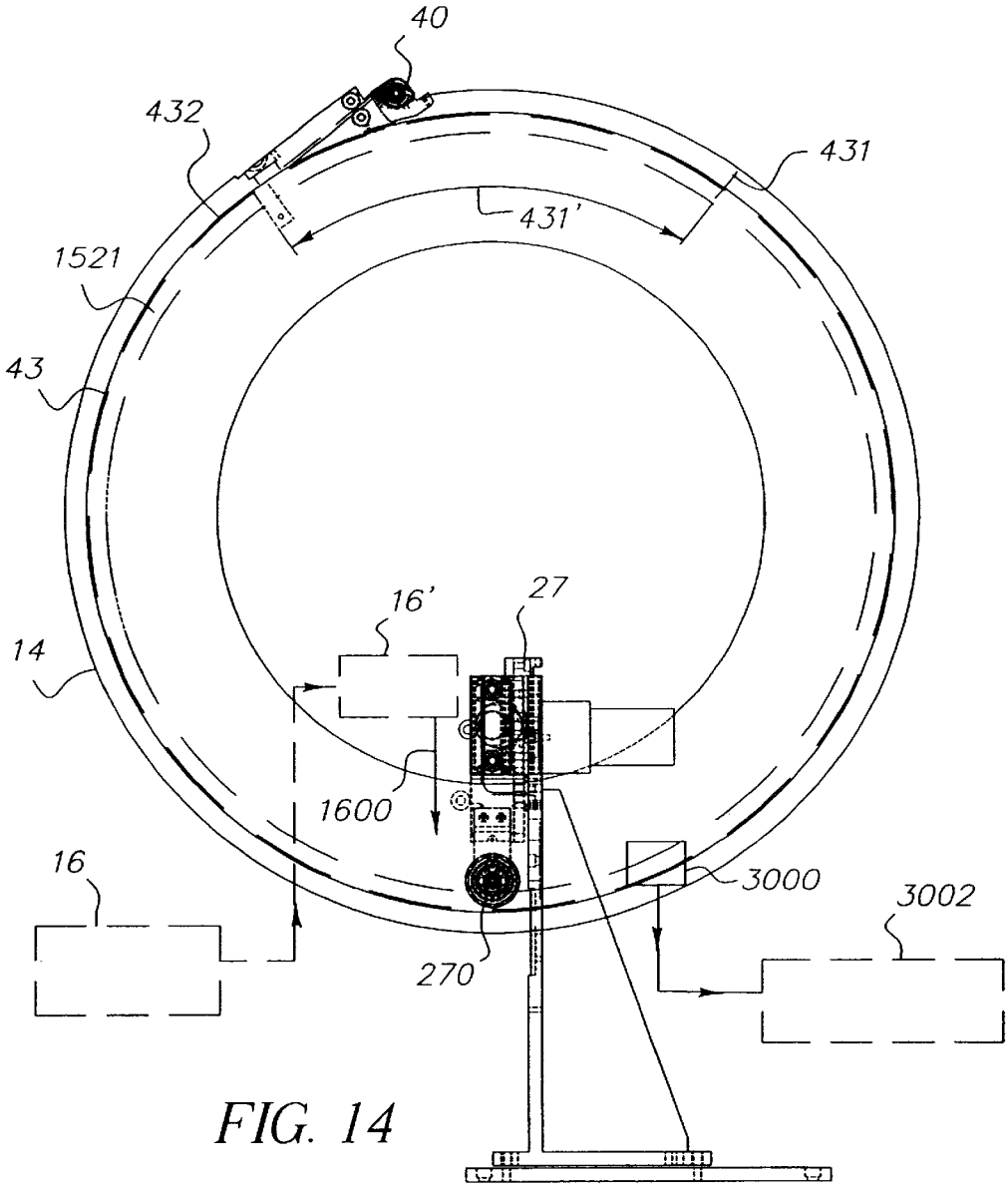
FIG. 14 depicts a sheet of film having a lead end and a tail end within the drum processing cavity of a circular processing drum.

FIG. 14 depicts circular processing drum 14 fully loaded with film 43 having a forward end 431 and a rearward end 432 within the drum processing cavity 1521 of circular processing drum 14. The back end of film 43 is maintained in cartridge 40. Film 43 is now positioned within circular processing drum 14 for chemical processing, wherein one or more processing fluids are deposited into circular processing drum 14 and placed in contact with film 43 for a desired period of time.

It is noted that the circumference of the drum will be longer than the length of the film to be processed. Therefore, when the film is loaded in drum 14, a section of drum 14 will not have film therein. This is referred to as a film-free zone 431' (FIG. 14). Prior to delivering chemistry by way of chemical supply 16 and a chemical delivery mechanism 16' (FIG. 14), clutch 250 is activated or engaged and drum 14 is controllably rotated with disk 30 so that film-free zone 431' is at a lower end or below chemical delivery mechanism 16'. Chemical delivery mechanism 16' is preferably of the type which drops or delivers chemistry into drum 14 in the direction of arrow 1600 (FIG. 14). The movement of film-free zone to an area below chemical delivery mechanism 16' prior to the delivery of chemicals prevents the chemicals from being dropped directly on the film which could cause uneven processing. Thereafter, processing occurs by continuously rotating the drum 14 and disk 30. Further, as shown in FIG. 14, in the lower portion of drum 14, film 43 passes between wheel 270 and an inner surface of drum 14. Rotation of drum 14 and disk 30 relative to wheel 270 helps to agitate the processing fluid in the vicinity of wheel 270 to promote processing. Drum 14 can be selectively rotated in a continuous or intermittent manner. Following the chemical processing steps, the film 43 is removed from circular processing drum 14 and exposed to a drying operation. One method of removing film 43 from circular processing drum 14 is shown in FIGS. 15A and 15B.

Figure 15A:
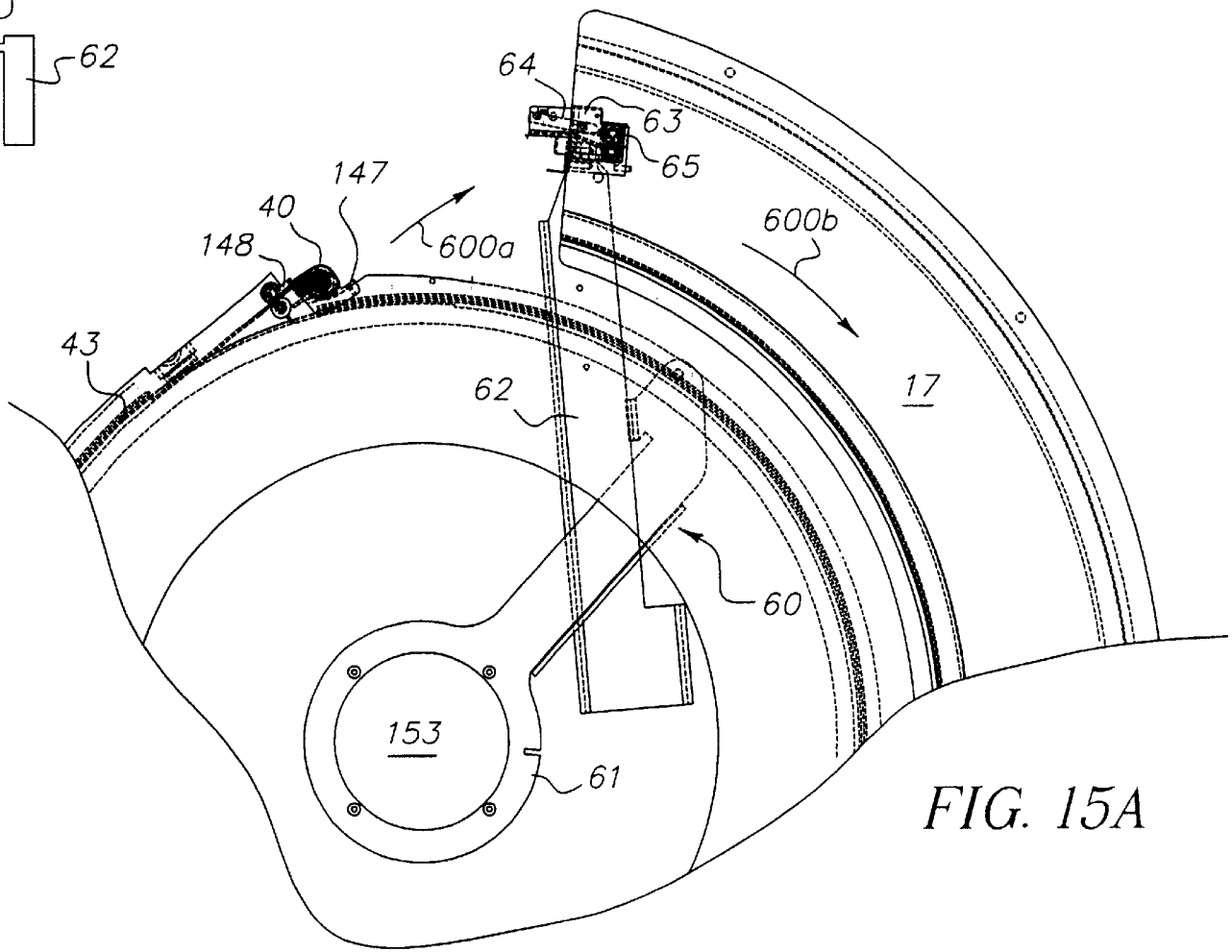
FIGS. 15A and 15B depicts an exemplary film transfer arm, which transfers film from a circular processing drum to a dryer.
Figure 15B:
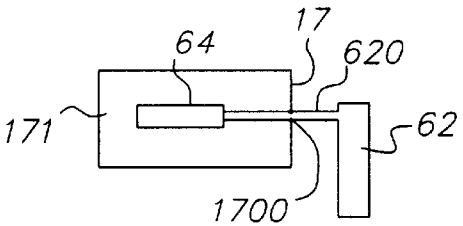

As shown in FIG. 15A, film transfer arm assembly 60 is positioned to move or pivot between circular processing drum 14 and dryer 17. Film transfer arm assembly 60 includes a lower arm member 61, which is rotatable around an axis of symmetry 153 of circular processing drum 14. Film transfer arm assembly 60 also includes an upper arm member 62, which is pivotally attached to lower arm member 61. At upper arm member end 63, film transfer arm assembly 60 includes a film cartridge gripper 64 and film strip gripper rolls 65. As shown in FIG. 15B, which is a front view of the entrance of dryer 17, a side wall of dryer 17 includes a slot 1700 with a rubber seal that extends along the length of the dryer. Upper arm member 62 includes a shaft 620 which extends from upper arm member 62, through slot 1700 and is connected to gripper 64. This permits transfer arm assembly 60 to pull gripper 64 and thus the film to be dried though the dryer.

In embodiments wherein the film 43 remains intact with film cartridge 40 (as described above), film cartridge gripper 64 of film transfer arm assembly 60 engages with film cartridge 40, pulls film cartridge 40 from loading area 147 and the strip of film 43 from circular processing drum 14 in direction 600*a*, and proceeds through dryer 17 in direction 600*b*. Therefore, cartridge 40 with processed film 43 attached and trailing therefrom is conveyed through dryer 17 to dry film 43 by, for example, the blowing of air into dryer 17. In other embodiments where the film 43 is detached from film cartridge 40 (described below), film sheet gripper rolls 65 grip an edge of film 43 as film 43 exits film input slot 148 of circular processing drum 14. Film sheet gripper rolls 65 of film transfer arm assembly 60 pull film 43 from circular processing drum 14 and proceeds through dryer 17. Once dried, film 43 is re-wound back into its cartridge 40 prior to proceeding to scanner 18'.

Figure 16:
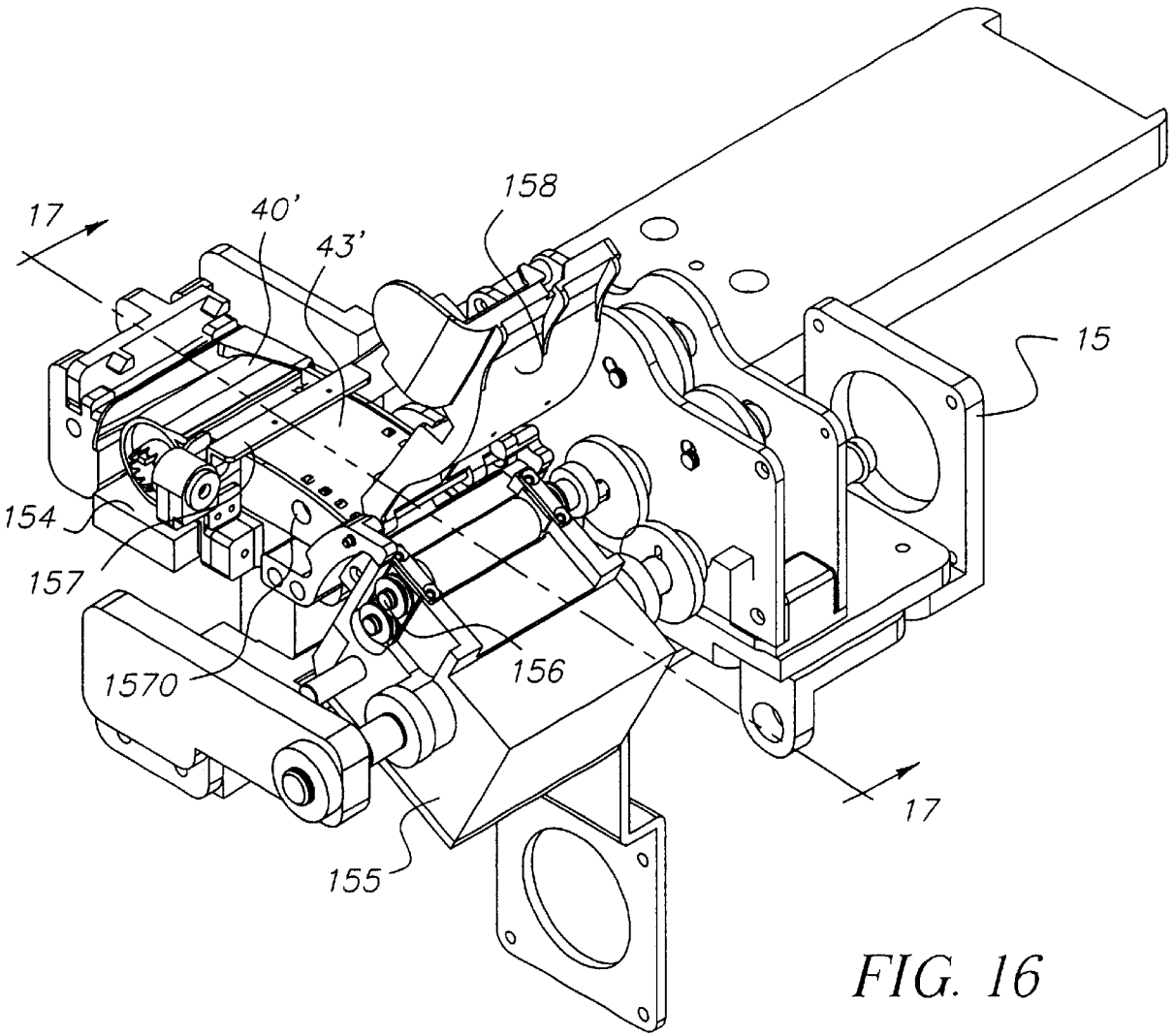
FIG. 16 depicts an exemplary film loading/unloading device used in a film-loading method of the present invention wherein film is separated from its corresponding film cartridge.

In a further film-loading method, the film is separated from its film cartridge prior to processing within circular processing drum 14 (for example, 35 mm film). In this method, a film loading/unloading device, such as exemplary film loading/unloading device 15 as shown in FIG. 16, may be used. Film loading/unloading device 15 includes a film cartridge loading area 154, which can be enclosed by closing a door 158. In film loading area 154, an operator extracts the tongue of film 43' from cartridge 40' and engages the perforations on film 43' with sprockets on a driven roller 1570. Thereafter door 158 is closed and film 43' proceeds into festoon box 155 through festoon box nip rollers 156. Once a desired length of film is removed from film cartridge 40', a cutter 157 slices film 43' to separate film 43' from film cartridge 40'. Any counter device (not shown) may be used to measure the length of the strip of film 43' passing through festoon box nip rollers 156. The length measurement is used in further processing steps as described below.

Figure 17:
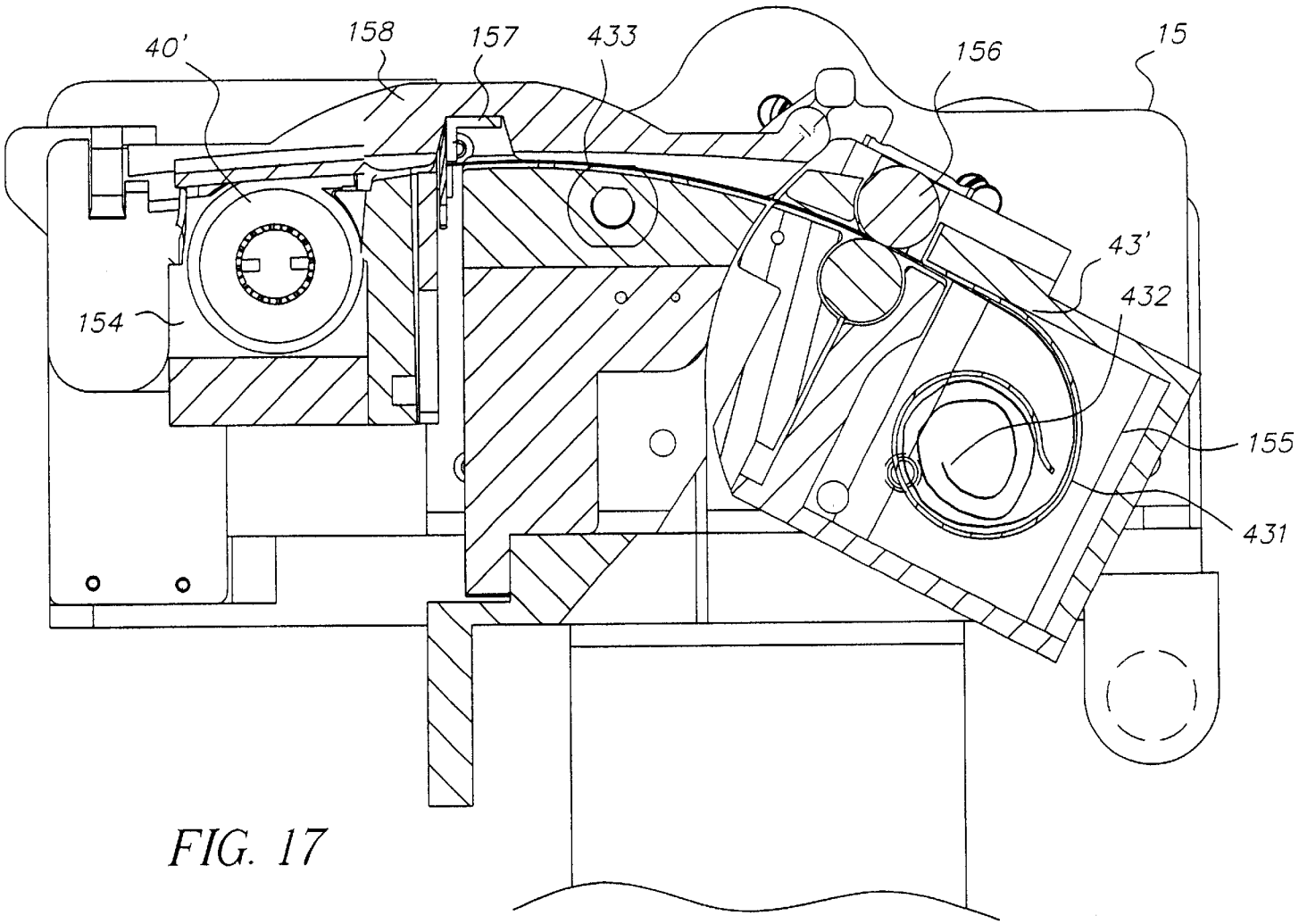
FIG. 17 depicts a cross-sectional view of the exemplary film loading/unloading device as seen along line B—B in FIG. 16.

FIG. 17 depicts a cross-sectional view of film loading/unloading device 15 as seen along line 17—17 in FIG. 16. As shown in FIG. 17, film cartridge 40' is positioned in film cartridge loading area 154 while a strip of film 43' is removed from film cartridge 40' and transported to festoon box 155 where it is turned. In this film-loading operation, a reverse roll of film 431 is formed from the film 43' in festoon box 155. A lead end of film 432 becomes the innermost portion of the reverse roll 431 while a tail end of film 433 becomes the outermost portion of reversed roll 431. When the film 43' is subsequently fed into circular processing drum 14 (as previously described), tail end 433, which contains the last exposures on the strip of film 43', is fed into circular processing drum 14 first.

Figure 18:
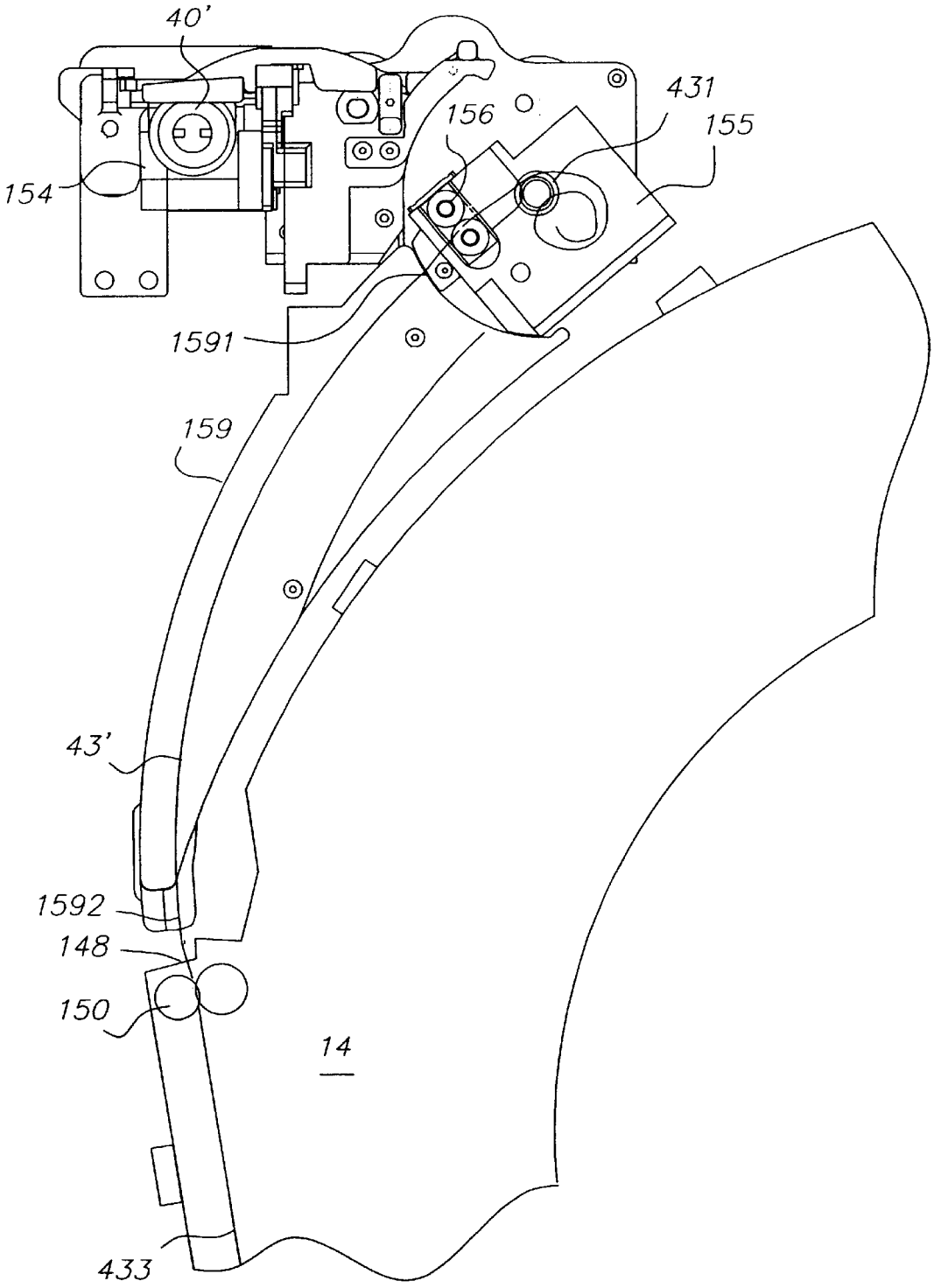
FIG. 18 depicts an exemplary film-loading guide used to load a film roll into a circular processing drum.

A film-loading guide 159 is used to load reverse roll 431 into circular processing drum 14 as shown in FIG. 18. Festoon box 155 rotates from an initial position (as shown in FIGS. 16 and 17) to a film-loading position as shown in FIG. 18. Festoon box nip rollers 156 turn to advance tail end 433 of reverse roll 431 into film-loading guide 159 at guide entrance slot 1591. The film 43' exits the film-loading guide 159 at guide exit slot 1592 positioned adjacent to film input slot 148 of circular processing drum 14. Once the tail end 433 of the strip of film 43' enters into circular processing drum 14, driven nip rollers 150 grab the film 43' and advance the film 43' into circular processing drum 14 as described above. It should be noted that in this film-loading method, nip rollers 150 are programmed to advance the film 43' into circular processing drum 14 a specific length, which corresponds to the length of film inputted into festoon box 155 and measured via festoon box nip rollers 156 as described above. In other words, nip rollers 150 advance the strip of film 43' into circular processing drum 14 so that lead end 432 of film 43' remains nipped between nip rollers 150 during chemical processing (i.e., lead end 432 of the strip of film 43' does not enter into drum processing cavity 1521). This permits all of the exposed areas of the film 43' to be in the processing area in the drum.

Figure 19:
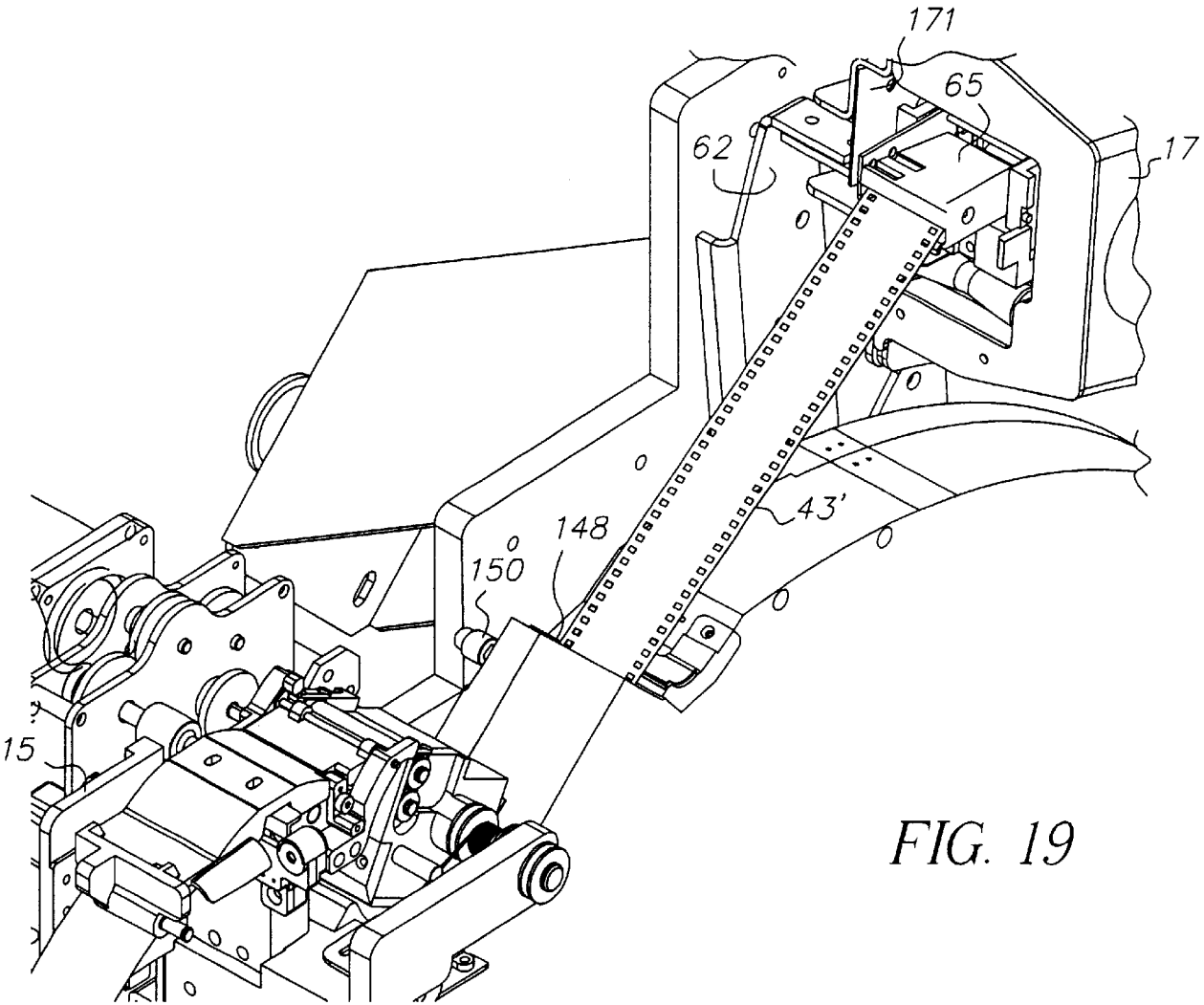
FIG. 19 depicts a film transfer step, wherein a strip of film is transferred from a circular processing drum to a dryer by film sheet gripper rolls attached to a film transfer arm.
Figure 20:
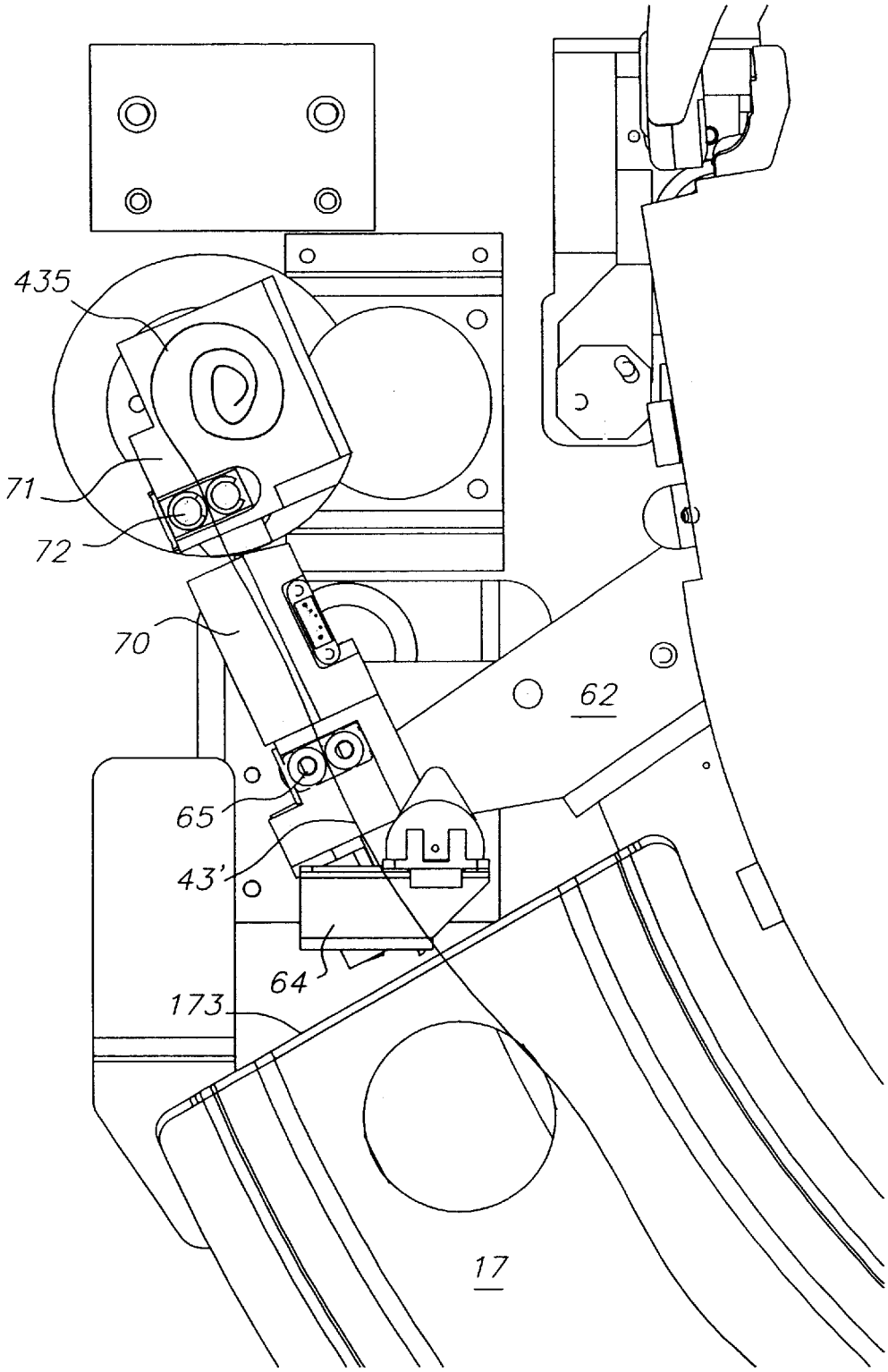
FIG. 20 depicts a film processing step, wherein a strip of film exits a dryer into a scanner festoon box.

Following the chemical processing steps, film 43' is transferred to dryer 17 by film transfer arm assembly 60 as described above. As shown in FIG. 19, the strip of film 43' is pulled from circular processing drum 14 through film input slot 148 by film sheet gripper rolls 65 attached to upper transfer arm member 62. Nip rollers 150 provide a first end (corresponding to lead end 432) to film sheet gripper rolls 65. In FIG. 19, film sheet gripper rolls 65 are shown positioned at dryer entrance 171. From this position, film sheet gripper rolls 65 proceed through dryer 17 pulling the film 43' through dryer 17. As shown in FIG. 20, upper film transfer arm member 62 exits dryer 17 at dryer exit 173 and comes into contact with a conduit 70. Film sheet gripper rolls 65 turn to advance the film 43' through conduit 70 and into scanner festoon box 71. Scanner festoon box nip rollers 72 grasp a leading edge of film 43' and force film 43' into scanner festoon box 71 forming scanner film roll 435. Scanner festoon box nip rollers 72 advance film 43' into scanner festoon box 71 a specific distance equal to the predetermined length of film 43' so that the tail end of film 43' remains nipped between scanner festoon box nip rollers 72 to go to the scanner.

Figure 21:
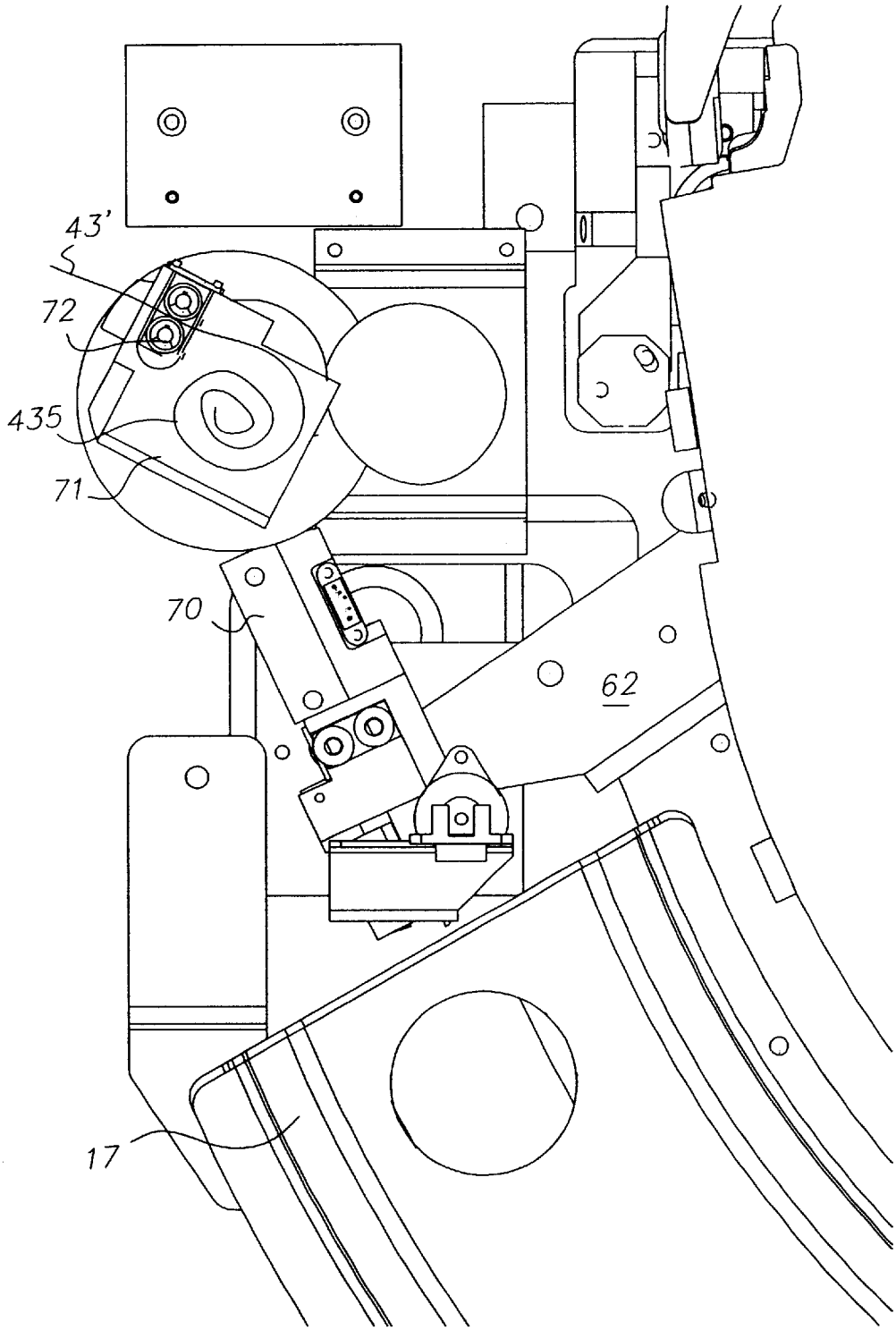
FIG. 21 depicts a film processing step, wherein a strip of film exits a festoon box and proceeds to a scanner.

In one embodiment, film 43' may be further processed by transporting the film 43' to scanner 18'. As shown in FIG. 21, scanner festoon box 71 rotates from an initial position (as shown in FIG. 20) to a secondary position so that the film 43' may be fed to scanner 18'. Scanner 18' may supply image data to computer 2000 or a remote computer (not shown) for further image processing. Following scanning, the film 43' may be packaged as a film roll or as strips of film and returned to the customer along with scanned photographs in electronic format on an electronic disc if desired.

A number of commercially available films may be loaded according to the film-loading method described above, namely, wherein the film is separated from its corresponding film cartridge during processing. Suitable films, which may be used in this particular film-loading method, include, but are not limited to, 135 mm film. Desirably, 135 mm film is loaded into the photographic processor of the present invention according to this method.

The photographic processor as described may be used to process one or more types of film. Suitable films include, but are not limited to, APS film, 135 mm film, etc. Desirably, the photographic processor is designed to process APS film, 135 mm film, or both APS and 135 mm film, however, it is recognized that the processor can further process 120 or 110 format film. The photographic processor may be categorized as a "single-roll", "single use" or "batch" processor given that the circular processing drum only chemically processes one roll of film at a time.

The photographic processor as described may include other components other than those described in FIGS. 1–21. For example, the photographic processor may include an operator interface control panel operationally associated with computer 2000 (FIG. 1); a display screen; a control unit, wherein the control unit accepts input from a processor user, provides machine settings to one or more components of the processor based on the input of the user, and controls and executes a processing operation of the processor; and multiple film loading doors on an outer surface of the photographic processor housing. In one desired embodiment, the photographic processor is used to process APS film and 135 mm film. In this embodiment, the photographic processor has two separate film loading doors on an outer surface of the photographic processor housing, one for an APS film cartridge and the other for a 135 mm film cartridge.

The photographic processor as described may use any conventional chemical delivery system known in the art as long as the chemical delivery system is capable of inputting one or more processing fluids into the circular processing drum. Suitable chemical delivery systems deliver one or more processing fluids including, but not limited to, a developing solution, a bleach solution, a fix solution, a wash solution, a combination or a concentrate thereof. Desirably, the chemical delivery system comprises one or more separate containers for each of the processing fluids. For example, the chemical delivery system may comprise one or more separate containers containing a developing solution, one or more separate containers containing a bleach solution, one or more separate containers containing a fix solution, and one or more separate containers containing a wash solution. In one embodiment of the present invention, the chemical delivery system used in the photographic processor comprises one container of developing solution, one container of bleach solution, one container of fix solution, and at least one container of wash solution.

Desirably, the photographic processor of the present invention utilizes a chemical delivery system comprising "working strength" chemical solutions. As used herein, the term "working strength" is used to describe chemical solutions, which are prepackaged in separate containers at concentrations that do not require dilution with other solutions (i.e., a source of water), and can be used as is. The system can very easily work with concentrates that are measured, diluted and heated on board. They can be diluted with water (if a supply is available) or with a simple rinsing solution that contains water and a surfactant.

Further, the photographic processor as described may use any conventional chemical removal system to remove or discard one or more processing fluids from the circular processing drum. Suitable chemical removal systems include, but are not limited to, a suction device or a drain 3000 (FIG. 14) in the side wall of the circular processing drum. Typically, the chemical removal system further comprises a chemical waste reservoir 3002 (FIG. 14) for storing one or more processing fluids removed from the drum. Desirably, the chemical waste reservoir is designed to contain all of the waste resulting from the use of all of the processing fluids contained in the chemical delivery system.

As described with reference to FIG. 14, when drum 14 is fully loaded with film, chemical delivery mechanism 16' can be used to drop or supply processing solution onto the film. In the case of drum 14, the emulsion side of the film would be facing the rotational axis of processing drum 14 so that the chemical solution from chemical delivery mechanism 16' would be applied onto the emulsion side of the film. During a cleaning cycle, delivery mechanism 16' can further be used to provide washing solution onto the emulsion side of the film, as well as components of the processor. As is also described with reference to processing drum 14, when the processed film is removed from drum 14, it is removed through slot 148.

Figure 22:
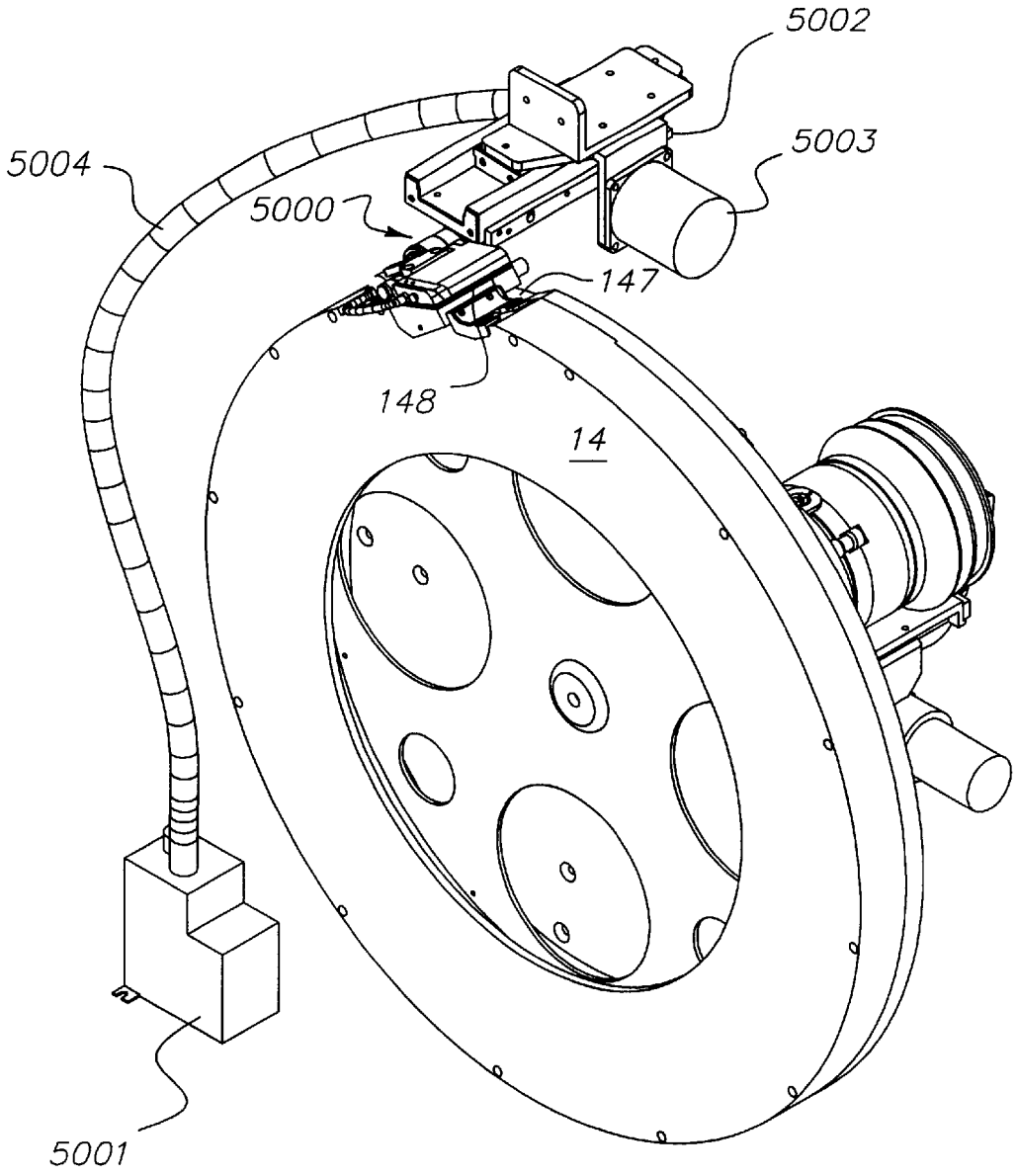
FIG. 22 shows a drum processor having a washing assembly in accordance with the present invention.

FIG. 22 illustrates an embodiment of the present invention in which a secondary washing assembly in the form of a washing assembly 5000 is provided in the general vicinity of slot 148. Washing assembly 5000 is effective to wash a back side or more specifically, a non-emulsion side of the film with washing solution as the processed film is removed through slot 148. As shown in FIG. 22, washing assembly 5000 is placed on an outer perimeter of drum 14 in the general vicinity of slot 148. Associated with washing assembly 5000 is a pump 5001 associated with a washing solution source such as a tank. Pump 5001 pumps washing solution through tube 5004 to washing assembly 5000. As is also shown in FIG. 22, a bracket or movable plate member 5002 is operationally associated with a motor 5003, to support and move washing assembly 5000 into an engagement or open state where washing solution is provided to processing drum 14, and a non-engagement or closed state where the washing assembly 5000 is closed so as to stop the application of washing solution to processing drum 14.

Figure 23:
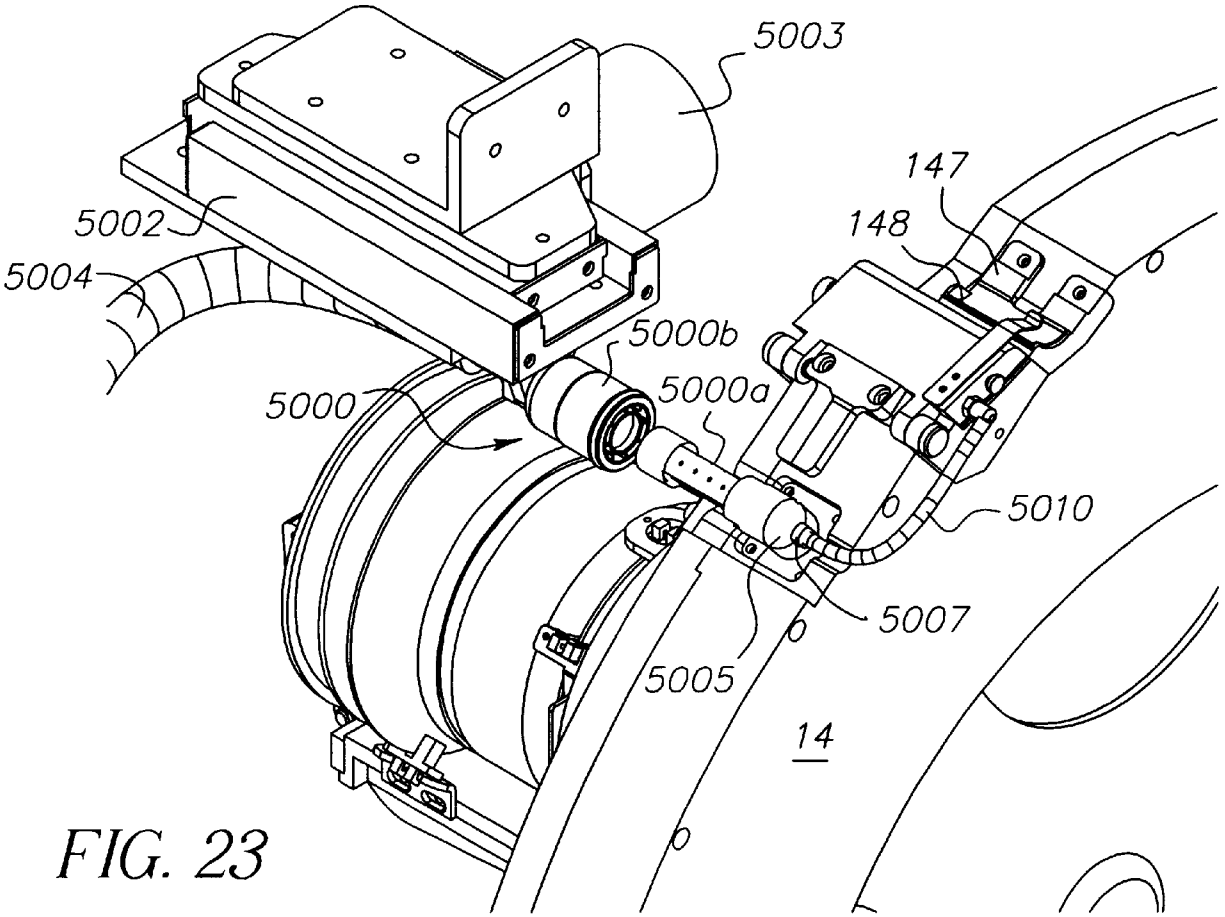
FIG. 23 is a view of the washing assembly of FIG. 22, with the washing assembly being in a disengaged or closed state.

FIG. 23 is a view of washing assembly 5000 relative to the outer perimeter of drum 14 with respect to film cartridge loading area 147 and slot 148. As shown in FIG. 23, washing assembly 5000 includes a first valve member 5000*a* that includes a nozzle arrangement 5005. The outer perimeter of drum 14 includes an aperture 5007, such that nozzle arrangement 5005 of valve member 5000*a* is positioned to cover aperture 5007. Washing assembly 5000 further includes a second valve member 5000*b* that is associated with tube 5004 and is mounted on movable plate member 5002 so as to be moved into engagement with first valve member 5000*a*.

Figure 27:
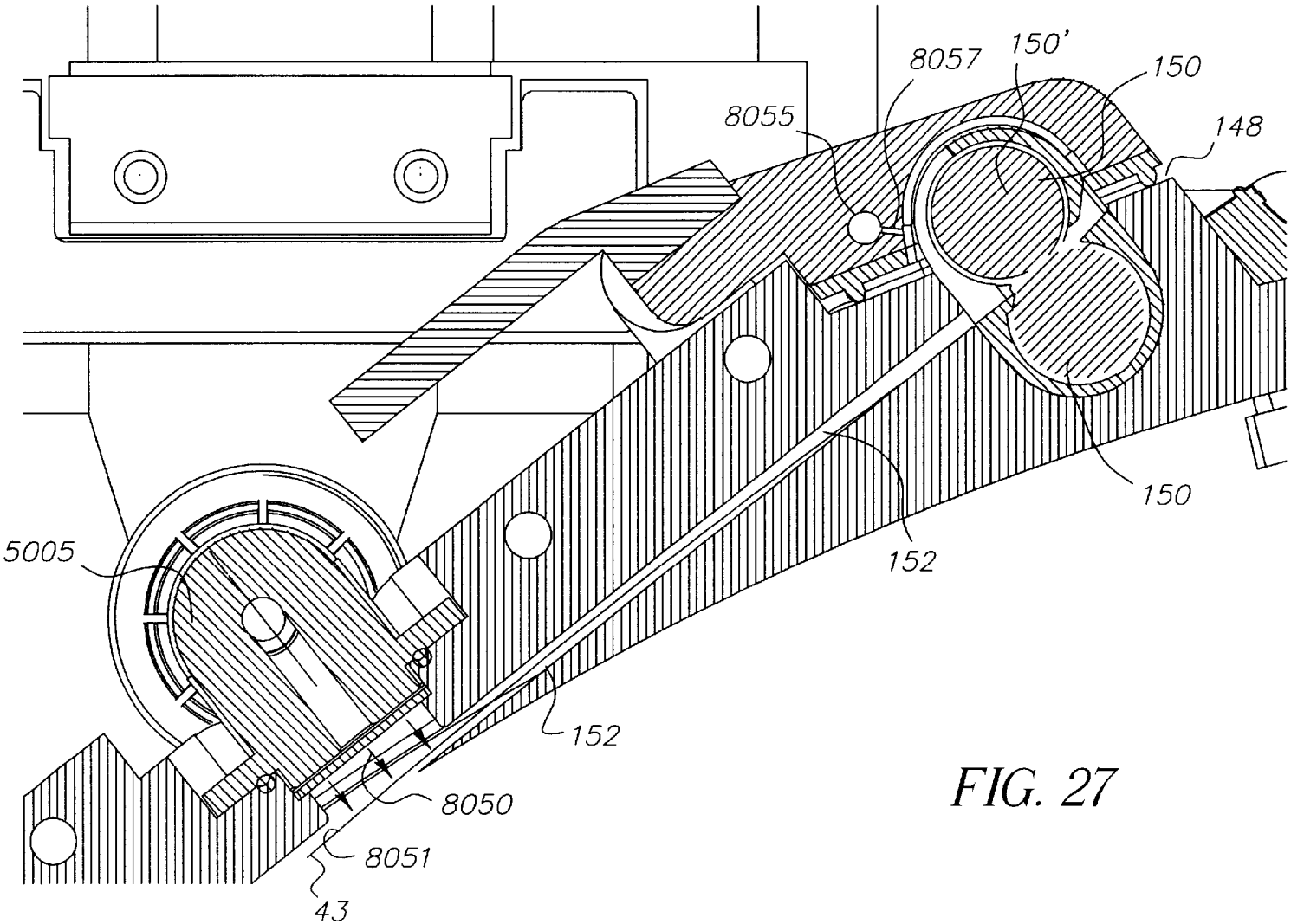
FIG. 27 is a cross-sectional view of the washing assembly mounted on the processing drum.

As further shown in FIG. 23, washing assembly 5000 includes a second tube 5010 which extends from nozzle arrangement 5005 to a bore or an entrance in the vicinity of rollers 150 as seen in FIG. 27 (the particulars of which will be described later).

Figure 24:
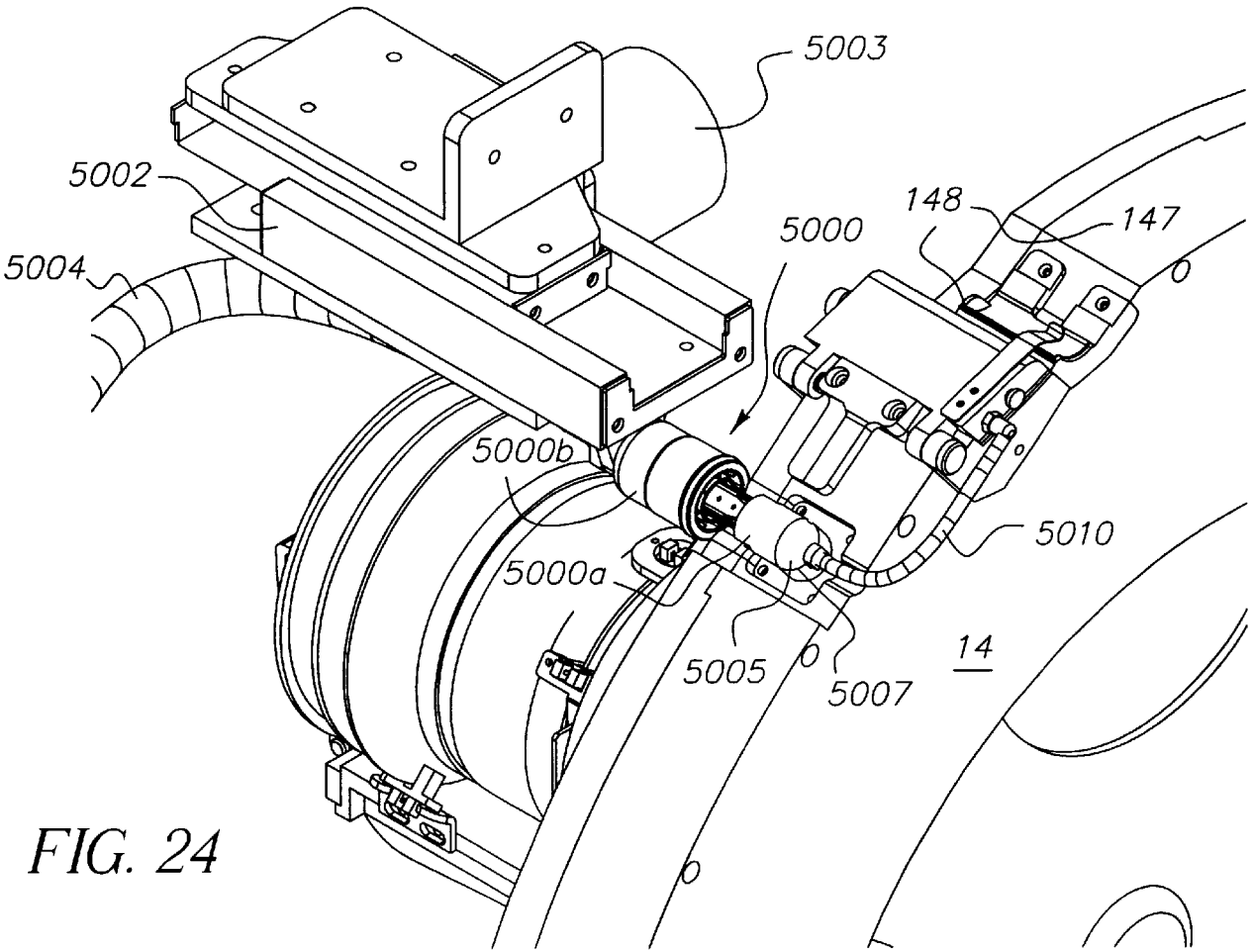
FIG. 24 is a view of the washing assembly of FIG. 22 in an engaged or open state.

FIG. 23 shows washing assembly 5000 in a non-engaged or closed state in which valve member 5000*b* is separated from valve member 5000*a*. To place washing assembly 5000 in an engaged or open state and more particularly, in a state in which washing solution is provided to drum 14, motor 5003 or optionally, motor 271 as previously described with the first embodiment, can be actuated to move plate member 5002 in a direction towards valve member 5000*a*. This causes valve member 5000*b* to be engaged with valve member 5000*a* as shown in FIG. 24, so as to provide for the supply of washing solution from a washing solution supply source to drum 14.

Figure 25A:
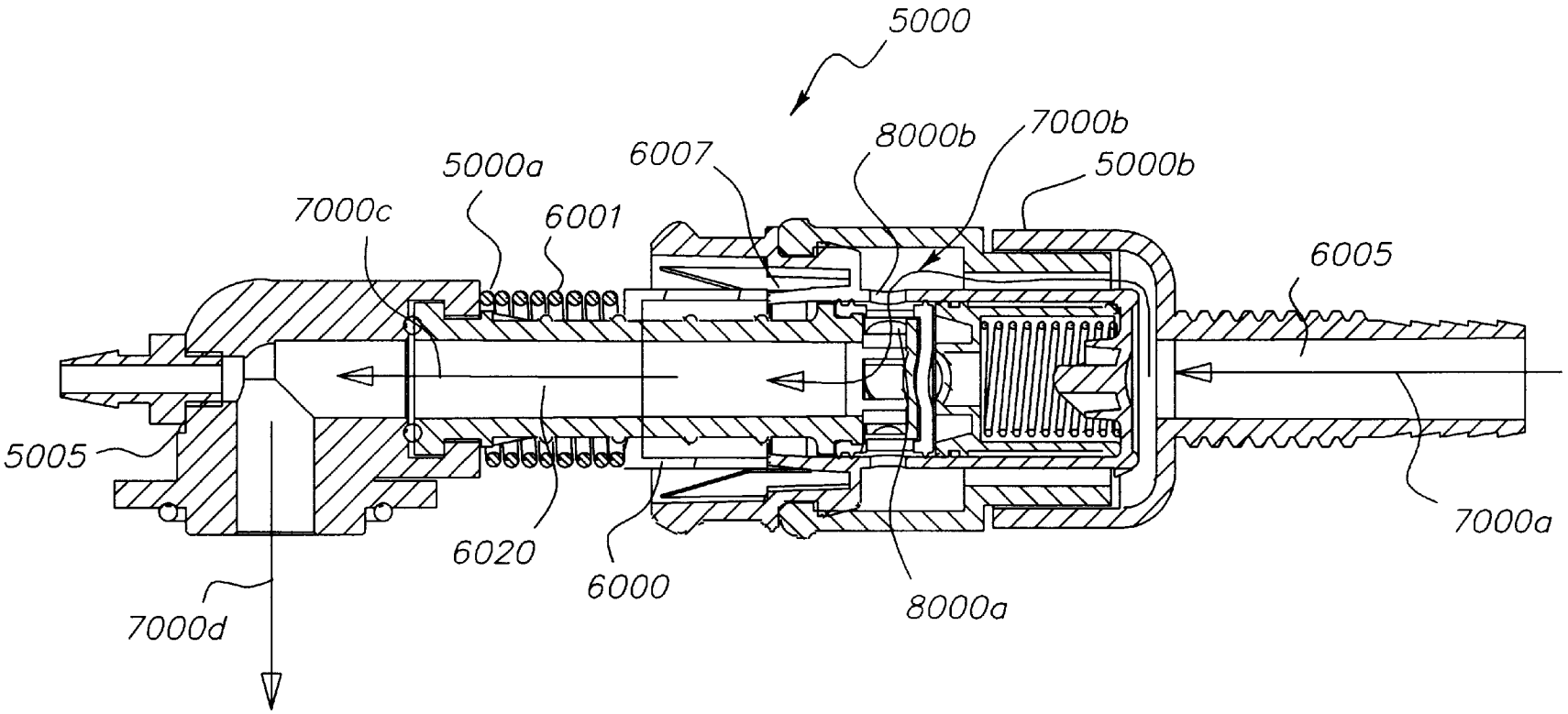
FIGS. 25A and 25B are respectively cross-sectional views of the washing assembly in an open position and a closed position.
Figure 25B:
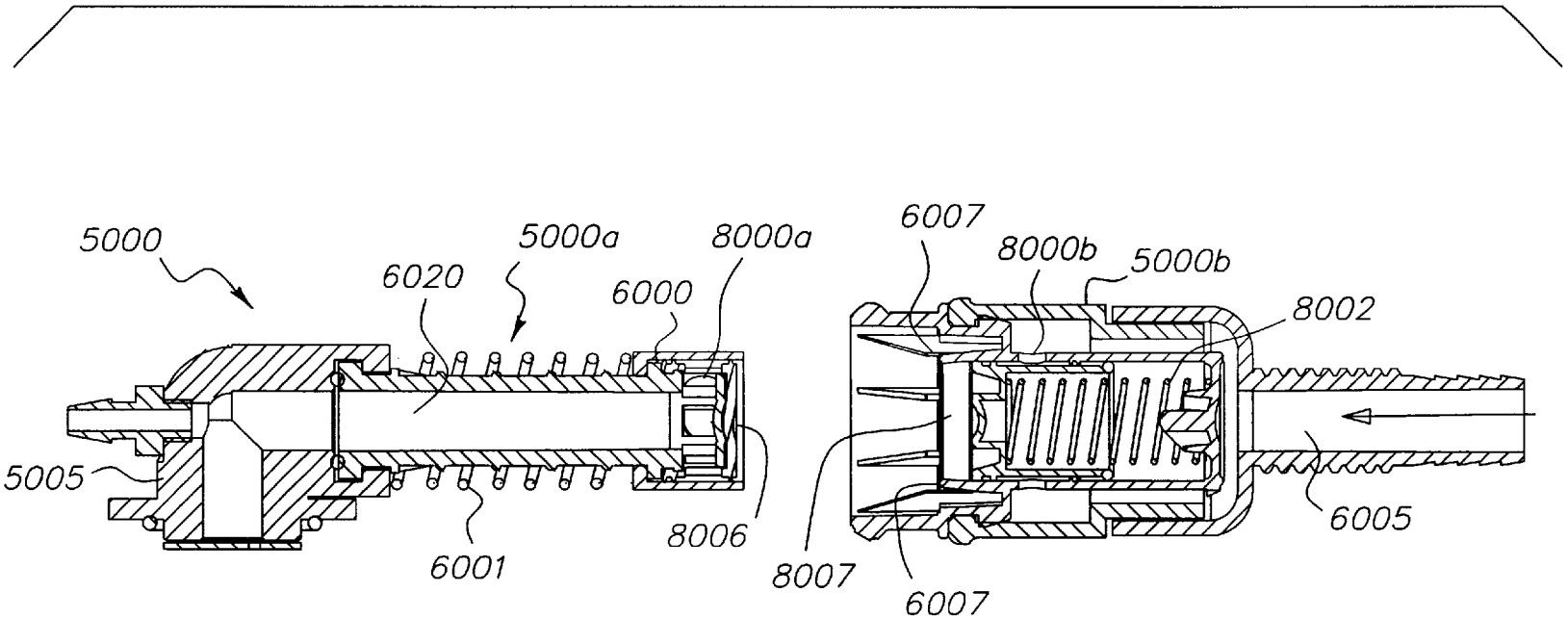

With respect to the open and/or closed positions of washing assembly 5000, reference is made to FIGS. 25A and 25B. FIG. 25A illustrates the engaged or open position of washing assembly 5000 for the purpose of supplying washing solution to drum 14. In the engaged or open position, motor 5003 is operated so as to move plate member 5002 to a position, which permits valve member 5000B to engage valve member 5000A (FIG. 25A). In the position illustrated in FIG. 25A, valve member 5000*b* is engaged with valve member 5000*a* so that an abutting member 6007 of valve member 5000*b* abuts against a cover member 6000 on valve member 5000*a*. This causes cover member 6000 to move against a resilient force of a spring 6001 on valve member 5000*a* to expose an opening 8000*a* on valve member 5000*a*. At the same time, the abutment of valve members 5000*a*, 5000*b* and specifically, a front portion 8006 of valve member 5000*a* against a further abutting member 8007 of valve member 5000*b*, causes abutting member 8007 to move against the force of a spring 8002 of valve member 5000*b*. This combination of movements causes opening 8000*a* of valve member 5000*a* to be aligned with opening 8000*b* of valve member 5000*b* to permit a fluid communication between a conduit 6005 of valve member 5000*b* and a conduit 6020 of valve member 5000*a*. This permits a flow of washing solution from pump 5001 through tube 5004 and through washing assembly 5000 in the manner illustrated by following the arrows 7000*a*, 7000*b*, 7000*c*, 7000*d* as shown FIG. 25A. Nozzle arrangement 5005 of FIG. 25A is positioned above aperture 5007 so as to permit the delivery of washing solution into drum 14.

FIG. 25B illustrates the non-engaged or closed position of washing assembly 5000. As shown in FIG. 25B, when it is desired to stop the supply of washing solution to drum 14, motor 5003 is operated so as to move plate member 5002 in a direction away from drum 14. This causes the movement of valve member 5000*b* away from valve member 5000*a* as shown in FIG. 25B. With this movement, the resilient force of spring 6001 will cause cover member 6000 to move forward as shown in FIG. 25B and thus cover opening 8000*a*. Also, the resilient force of spring 8002 will move further abutting member 8007 so as to block off hole 8000*b*. In the arrangement of FIG. 25B, fluid is prevented from leaking from valve number 5000*b*, and at the same time, a supply of washing solution to drum 14 is terminated.

Figure 26:
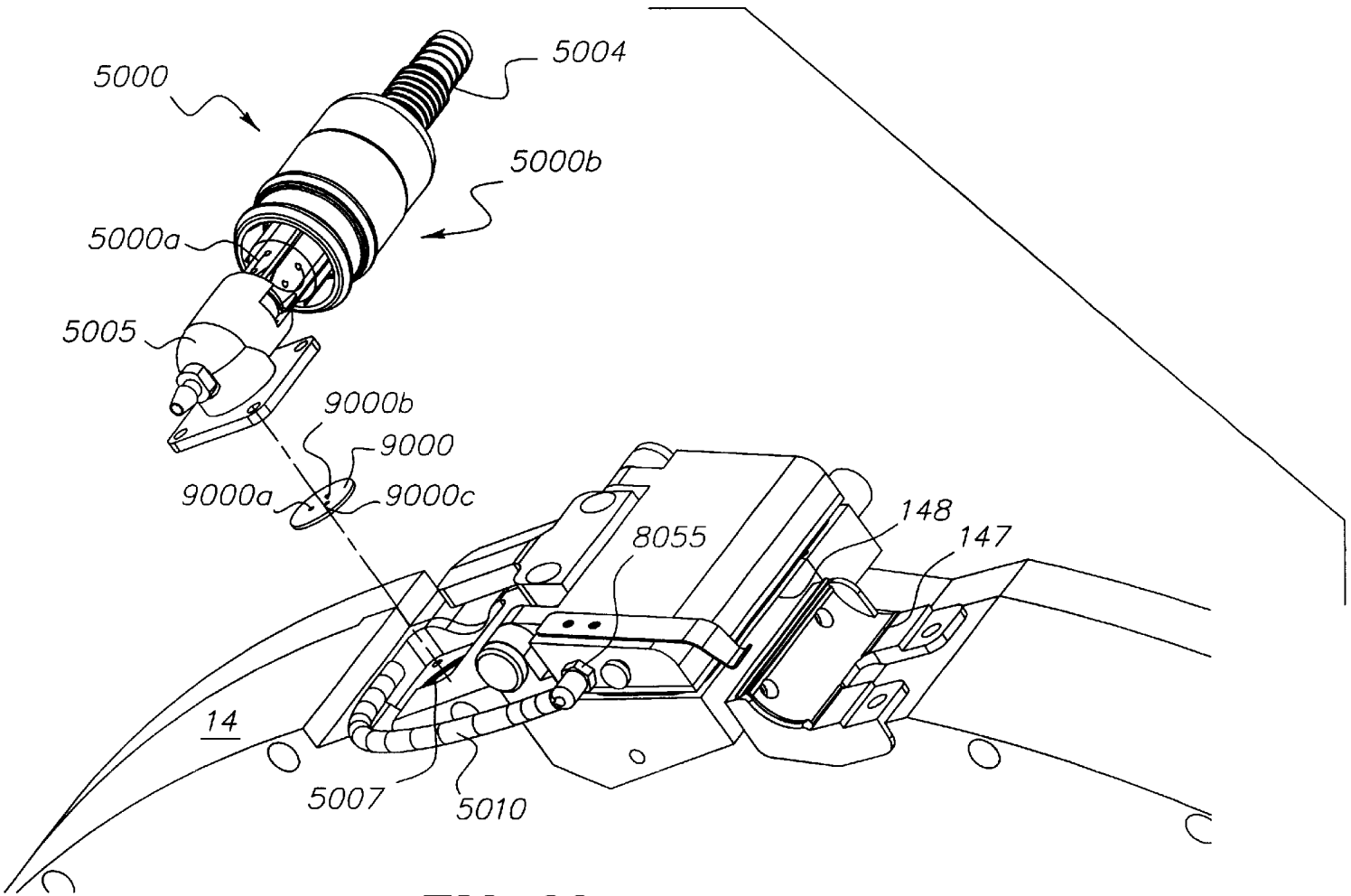
FIG. 26 illustrates the washing assembly separated from the processing drum.

FIG. 26 illustrates the cooperation between nozzle member 5005 of washing assembly 5000 and aperture 5007 on the outer perimeter of drum 14. As shown, nozzle member 5005 of valve member 5000*a* can be mounted so as to cover aperture 5007. Also, nozzle member 5005 can include a seal 9000 having through holes 9000*a*, 9000*b*, 9000*c* therethrough for the passage of washing solution, while at the same time minimizing leaks. Seal 9000 can be placed between nozzle member 5005 and aperture 5007.

An operation of washing assembly 5000 of the present invention will be described with reference to FIG. 27. As shown in FIG. 27, during removal of processed film from processing drum 14, the film will pass through film path 152 and be directed through slot 148. At this time, the film has been processed, and washing solution would have been applied on the emulsion side or surface of the photographic film and more specifically, the side of the photographic film which faces a rotational axis of the drum by way of chemical supply 16' (FIG. 14). As the film is being withdrawn from the drum, the washing assembly 5000 is engaged in the manner described by moving into the position shown in, for example, FIGS. 24 and 25A. This provides a fluid communication between valve member 5000*a* and valve member 5000*b* and permits the supply of washing solution to drum 14 through nozzle member 5005. More specifically, as shown in FIG. 27, washing solution will be supplied from nozzle member 5005 in the direction of arrows 8050 onto a non-emulsion surface 8051 of film 43 as film 43 is removed through film path 152 and slot 148. At the same time, as illustrated in FIG. 23, nozzle member 5005 is fluidly connected to a tube 5010 which leads to an opening 8055 (FIG. 27) in the vicinity of rollers 150. Opening 8055 as illustrated in FIG. 27 provides a fluid connection for tube 5010 into the vicinity of rollers 150. Opening 8055 includes a conduit or nozzle 8057 which leads to a surface of an upper roller 150' of the roller pair 150 as shown. Therefore, as film is pulled or led through slot 148, in addition to being supplied with washing solution on the non-emulsion surface by nozzle member 5005 as represented by arrows 8050, further washing solution is supplied through tube 5010, opening 8055, and conduit 8057 onto the surface of the upper roller 150' of the roller pair. This application of washing solution cleans any portion of the non-emulsion side of the film, which may not have been adequately cleaned at nozzle member 5005 before the photographic film exits through slot 148. Further, it aids in washing the roller pair 150 and other components of the processor.

Therefore, as described with respect to the present invention, the outer perimeter of drum 14 includes slot 148 through which the processed film is removed in a removal step. Slot 148 is in communication with film path 152 in the drum. The outer perimeter of drum 14 further includes an aperture 5007 which is located upstream of slot 148 with respect to a direction of travel of the processed film 143 when the processed film is removed through slot 148. Aperture 5007 opens to film path 152 and the processing chamber defined by processing film 14. Washing assembly 5000 includes a nozzle arrangement 5005 which is positioned at aperture 5007 to supply washing solution to the non-emulsion surface 8051 of processed film 143 in film path 152 as the processed film is removed through slot 148 and other components of the processor.

Washing assembly 5000 further includes supply tube 5010, which leads to an upper roller 150' of roller pair 150. Supply tube 5010 delivers the washing solution to bore or opening 8055 which directs washing solution to a surface of upper roller 150' of the roller pair 150. With the rotation of roller pair 150 as the film is being removed through 148, the washing solution will be sprayed onto the non-emulsion surface of the film as well as other components of the processor. Therefore, not only is the film cleaned but the rollers and the other components of the processor are also cleaned.

Washing assembly 5000 as described includes first valve member 5000*a* which includes nozzle arrangement 5005 and second valve member 5000*b*. First valve member 5000*a* including nozzle arrangement 5005 is mounted on the outer perimeter of drum 14 so as to cover aperture 5007. Second valve member 5000*b* is mounted on movable member or plate 5002 which is adapted to move second valve member 5000*b* between an opened or engaged position in which second valve member 5000*b* abuts against first valve member 5000*a* as shown in FIG. 25B to open first valve member 5000*a* and permit a supply of washing solution through nozzle arrangement 5005; and a non-engaged or closed position in which second valve member 5000*b* is spaced from the first valve member 5000*a* to stop the supply of washing solution through nozzle arrangement 5000, and at the same time, assure that there is no leak of solution from second valve member 5000*b*.

With the arrangement of the present invention, it is possible to provide washing solution to the emulsion surface of the processed film through the use of delivery mechanism 16' as previously described, and it is further possible to provide an additional washing of the non-emulsion through the use of washing assembly 5000.

As described, the movement of the valve member 5000*b* can be done in an automated manner by way of a motor which can be associated with, for example, a processor or computer so as to provide for the application of washing solutions at an appropriate time during the processing. For example, the appropriate time for washing can be set whenever the processed film is removed from the drum, and/or can also be set to supply washing solution between processing stages so as to facilitate the application of washing solution to the components of the processor.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

The invention has been described in detail with particular reference to certain preferred embodiments thereof, but it will be understood that variations and modifications can be effected within the spirit and scope of the invention.

What is claimed is:

1. A photographic processor comprising:

a circular processing drum which defines a processing chamber for processing photographic film therein, an outer perimeter of said drum comprising a slot through which processed film which is processed in said processing chamber is removed, said slot being in communication with a film path in said drum, said outer perimeter further comprising an aperture located upstream of said slot with respect to a direction of travel of said processed film when the processed film is removed through said slot, said aperture opening to said film path in said processing chamber; and a washing assembly comprising a nozzle arrangement, said nozzle arrangement being positioned at said aperture to supply washing solution to a surface of the processed film in said film path as the processed film is being removed through said slot.

2. A photographic processor according to claim 1, further comprising a roller pair for conveying film from said film path to said slot.

3. A photographic processor according to claim 2, wherein:

said washing assembly further comprises a supply tube which leads to an upper roller of said roller pair, said supply tube delivering the washing solution to the upper roller of said roller pair and the surface of the processed film as the processed film passes between the roller pair during the removal of the processed film through said slot.

4. A photographic processor according to claim 1, wherein:

said washing assembly comprises a first valve member which includes said nozzle arrangement and a second valve member, said first valve member being mounted on the outer perimeter of said drum so as to cover said aperture, and said second valve member being mounted on a movable member which is adapted to move said second valve member between a first position in which the second valve member abuts against the first valve member to open the first valve member and permit a supply of washing solution through said nozzle arrangement, and a second position in which the second valve member is spaced from the first valve member to close the first valve member and stop the supply of washing solution through said nozzle arrangement.

5. A photographic processor according to claim 1, wherein film to be processed is inserted into said processing chamber and said film path through said slot.

6. A photographic processor according to claim 1, further comprising:

a disk positioned inside the drum, said disk comprising disk teeth along an outer perimeter of the disk that are capable of interengaging with holes along an edge of the film.

7. A photographic processor comprising:

a processing drum for processing photographic film therein, an outer perimeter of said drum comprising a slot through which processed film which is processed in said processing drum is removed, said slot being in communication with a film path in said drum;

rollers provided adjacent to said slot for conveying processed film from said film path and through said slot; and washing means for delivering washing solution to a surface of the processed film in said film path at a location upstream of said rollers with respect to a direction of travel of the processed film when the processed film is being removed through said slot, and delivering washing solution to said rollers.

8. A photographic processor according to claim 7, wherein film to be processed is inserted into said processing drum and said film path through said slot.

9. A method of processing photographic material, the method comprising the steps of:

inserting film to be processed into a circular processing drum, said film being inserted through a slot in an outer perimeter of the circular processing drum;

supplying at least one processing solution onto an emulsion surface of said film in said processing drum to process said film;

discharging the at least one processing solution from said processing drum;

supplying a first washing solution into said processing drum and onto at least the emulsion surface of said film;

discharging the washing solution from said processing drum;

removing said processed film from said processing drum through said slot; and supplying a second washing solution to a non-emulsion side of said processed film as the processed film is removed through said slot.

10. A method of washing processed photographic film, the method comprising the steps of:

supplying a first washing solution onto a first surface of photographic film after the photographic film has been processed in a processing drum;

removing the processed film from the processing drum; and supplying a second washing solution onto a second surface of the photographic film as the photographic film is removed from the processing drum.

11. A method according to claim 10, wherein said first surface of the photographic film is an emulsion surface and said second surface of the photographic film is a non-emulsion surface.

* * * * *